US012516865B2

(12) United States Patent
Park et al.

(10) Patent No.: US 12,516,865 B2
(45) Date of Patent: Jan. 6, 2026

(54) REFRIGERATOR

(71) Applicant: LG ELECTRONICS INC., Seoul (KR)

(72) Inventors: Kyungwook Park, Seoul (KR); Kihwang Kim, Seoul (KR); Jongkwon Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 323 days.

(21) Appl. No.: 18/102,200

(22) Filed: Jan. 27, 2023

(65) Prior Publication Data

US 2023/0243573 A1 Aug. 3, 2023

(30) Foreign Application Priority Data

Jan. 28, 2022 (KR) ..... 10-2022-0013686

(51) Int. Cl.
*F25D 23/00* (2006.01)

(52) U.S. Cl.
CPC ..... *F25D 23/003* (2013.01); *F25D 23/006* (2013.01)

(58) Field of Classification Search
CPC .... F25D 17/045; F25D 17/065; F25D 17/067; F25D 17/08; F25D 23/003; F25D 23/006
See application file for complete search history.

(56) References Cited

U.S. PATENT DOCUMENTS 5,899,083 A * 5/1999 Peterson ..... F25D 17/065 62/186
9,175,898 B2 11/2015 Chae et al.
2020/0284493 A1 9/2020 Lee et al.
2020/0326116 A1 10/2020 Hong et al.
(Continued)

FOREIGN PATENT DOCUMENTS

EP 3904792 11/2021
KR 10-1999-0072299 A 9/1999
KR 10-2007-0010547 A 1/2007
(Continued)

OTHER PUBLICATIONS

Extended European Search Report dated May 24, 2023 issued in Application No. 23153751.5.
(Continued)

*Primary Examiner* — Tavia Sullens
(74) *Attorney, Agent, or Firm* — KED & ASSOCIATES

(57) ABSTRACT

There is disclosed a refrigerator including an evaporator configured to generate cold air; and a grill fan assembly configured to blow the cold air generated by the evaporator to a refrigerator compartment and a freezer compartment, wherein the grill fan assembly may include a freezing fan module configured to blow cold air to the refrigerator compartment comprising a first storage chamber and a second storage chamber and the freezer compartment; a first flow path opening/closing damper configured to selectively block the cold air blown to the first storage chamber; and a second flow path opening/closing damper configured to
(Continued)

selectively block the cold air blown to the second storage chamber, and the first flow path opening/closing damper and the second flow path opening/closing damper may overlap in at least predetermined area in a front-rear direction.

21 Claims, 23 Drawing Sheets

(56) References Cited

U.S. PATENT DOCUMENTS

2022/0099352 A1 3/2022 Lee et al.

FOREIGN PATENT DOCUMENTS

| | | | | | |
|---|---|---|---|---|---|
| KR | 20150045796 | A | * | 4/2015 | ..... F25D 17/065 |
| KR | 10-2020-0121110 | A | | 10/2020 | |
| KR | 10-2021-0053173 | A | | 5/2021 | |
| WO | WO-2017032149 | A1 | * | 3/2017 | ..... F25D 11/02 |
| WO | WO 2021206241 | | | 10/2021 | |

OTHER PUBLICATIONS

European Notice of Allowance issued in Application No. 23 153 751.5 dated Apr. 7, 2025.

* cited by examiner

REFRIGERATOR

CROSS-REFERENCE TO RELATED APPLICATION

This application claims priority to and the benefit of Korean Patent Application No. 10-2022-0013686, filed in Korea on Jan. 28, 2022, the disclosure of which is incorporated herein by reference in its entirety.

BACKGROUND

1. Field

The present disclosure relates to a refrigerator, more particularly, a refrigerator that may increase an inner volume of a refrigerator compartment.

2. Background

A refrigerator is a home appliance configured to supply cold air generated by refrigerant circulation to a storage chamber (e.g., a refrigerator compartment or a freezer compartment) to keep various kinds of storage targets fresh for a long time in the storage chamber.

A refrigerator compartment refrigerates the storing targets and the freezer compartment freezes the storing target. Due to this structure, the amount of supplied cold air needs to be adjusted differently so that the refrigerator compartment and the freezer compartment may maintain different temperatures.

A refrigerant circulating in the order of a compressor, a condenser, an evaporator and a compressor flows into an evaporator, and the liquid refrigerant is vaporized into gaseous refrigerant. During this process, the cold air supplied to the refrigerator compartment and the freezer compartment may be generated by taking heat from the inside of the refrigerator.

Accordingly, separate evaporators for generating cold air may be provided in the refrigerator compartment and the freezer compartment, respectively, so that the cold air generated by the independent evaporators may be supplied to the compartments, respectively.

When the separate evaporators are provided in the refrigerator compartment and the freezer compartment, respectively, independent cold air supply systems, each of which includes an evaporator for generating cold air, a grille fan assembly for blowing the generated cold air to the refrigerator compartment or the freezer compartment, and a cold air supply duct having a cold air path to supply the cold air, should be also be provided in the refrigerator compartment and the freezer compartment, respectively.

However, when the separate cold air systems mentioned above are provided in the refrigerator compartment and the freezer compartment, respectively, there is a problem in that inner volumes of the refrigerator compartment and the freezer compartment are reduced as much as the areas occupied by the cold air supply systems.

Meanwhile, the cold air generated by one evaporator may be supplied to the refrigerator compartment and the freezer compartment, without the separate evaporators provided in the refrigerator compartment and the freezer compartment, respectively.

Accordingly, the evaporator for generating cold air and the grille fan assembly for blowing the generated cold air to the refrigerator compartment and the freezer compartment may be disposed in the freezer compartment.

The cold air supply duct having the cold air path to supply the cold air generated in the freezer compartment to the refrigerator compartment may be disposed inside the refrigerator compartment.

In this instance, since the cold air needs to be supplied to the refrigerator and freezer compartments that require different temperatures and amounts of cold air through one evaporator and one grille fan assembly, a flow path opening/closing damper may be further provided in the refrigerator compartment to selectively block the cold air supplied to the refrigerator compartment.

For example, the amount of the cold air supplied to the refrigerator compartment may be adjusted by selectively opening and closing the flow path opening/closing damper disposed in the cold air supply duct.

Accordingly, the refrigerator compartment may have a shape protruding inwardly to sufficiently secure an area in which the flow path opening/closing module is disposed on the rear surface of the refrigerator compartment.

In particular, when the refrigerator compartment is partitioned off into a plurality of spaces that require different temperatures, a plurality of flow path opening/closing modules need to be provided to adjust the mounts of the cold air supplied to the divided spaces, respectively. Accordingly, the refrigerator compartment has a shape further protruding inwardly.

As described above, as the area of the region protruding to the inside of the refrigerator compartment increases more and more, the inner volume of the refrigerator compartment is inevitably reduced by that increased amount.

The cold air flow path to the refrigerator compartment from the freezer compartment is blocked by closing the flow path opening/closing damper disposed in the refrigerator compartment, the cold air inside the freezer compartment may be replaced with the cold air inside the relatively humid refrigerator compartment based on the flow path opening/closing damper.

In this instance, since the flow path opening/closing damper is positioned in the refrigerator compartment, the cold air inside the freezer compartment could rise to a rear surface of the refrigerator compartment having a relatively humid environment, which might cause a problem of dew condensation near the flow path opening/closing damper.

To solve the problem of dew condensation, an insulating material may be reinforced to prevent heat exchange between the cold air of the freezer compartment, which rises up to the area of the flow path opening/closing damper, and the refrigerator compartment.

However, in this instance, there could be another problem in that the inner volume of the refrigerator compartment is additionally reduced by the added thickness of the reinforced insulating material.

BRIEF DESCRIPTION OF THE DRAWINGS

Arrangements and embodiments may be described in detail with reference to the following drawings in which like reference numerals refer to like elements and wherein.

DETAILED DESCRIPTION

Figure 1A:
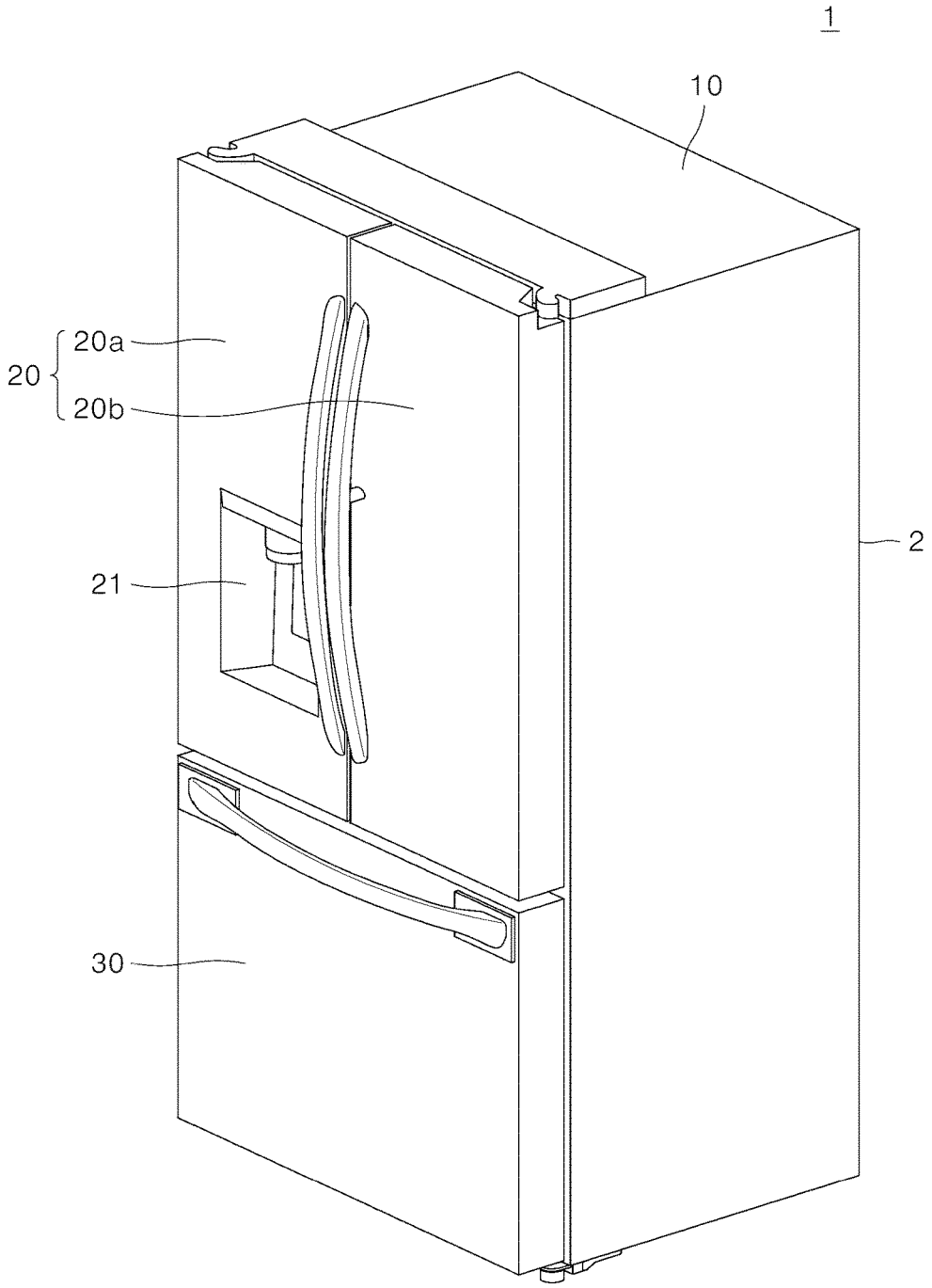
FIGS. 1A and 1B are front perspective views showing a state where a door of a refrigerator including an ice-making chamber is closed and a state where a door of a refrigerator including no ice-making chamber is closed.

The above-described aspects, features and advantages are specifically described hereunder with reference to the accompanying drawings such that one having ordinary skill in the art to which the present disclosure pertains can easily implement the technical spirit of the disclosure. In the disclosure, detailed descriptions of known technologies in relation to the disclosure are omitted if they are deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Throughout the disclosure, each component can be provided as a single one or a plurality of ones, unless explicitly stated to the contrary.

Hereinafter, expressions of 'a component is provided or disposed in an upper or lower portion' may mean that the component is provided or disposed in contact with an upper surface or a lower surface. The present disclosure is not intended to limit that other elements are provided between the components and on the component or beneath the component.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Throughout the disclosure, the terms "A and/or B" as used herein can denote A, B or A and B, and the terms "C to D" can denote C or greater and D or less, unless stated to the contrary.

Hereinafter, a refrigerator according to several embodiments will be described.

[Overall Structure of Refrigerator]

Figure 1B:
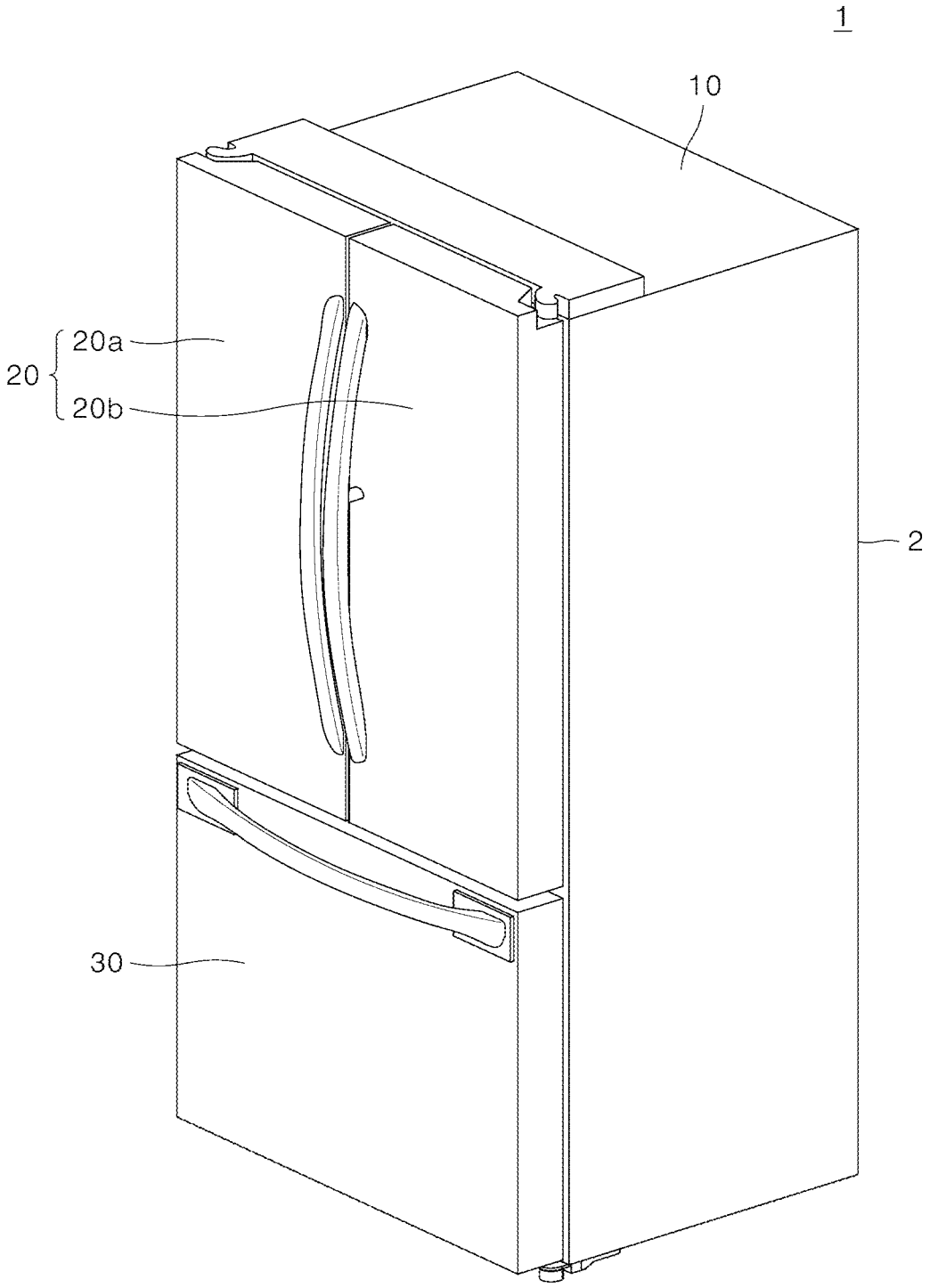
Figure 2:
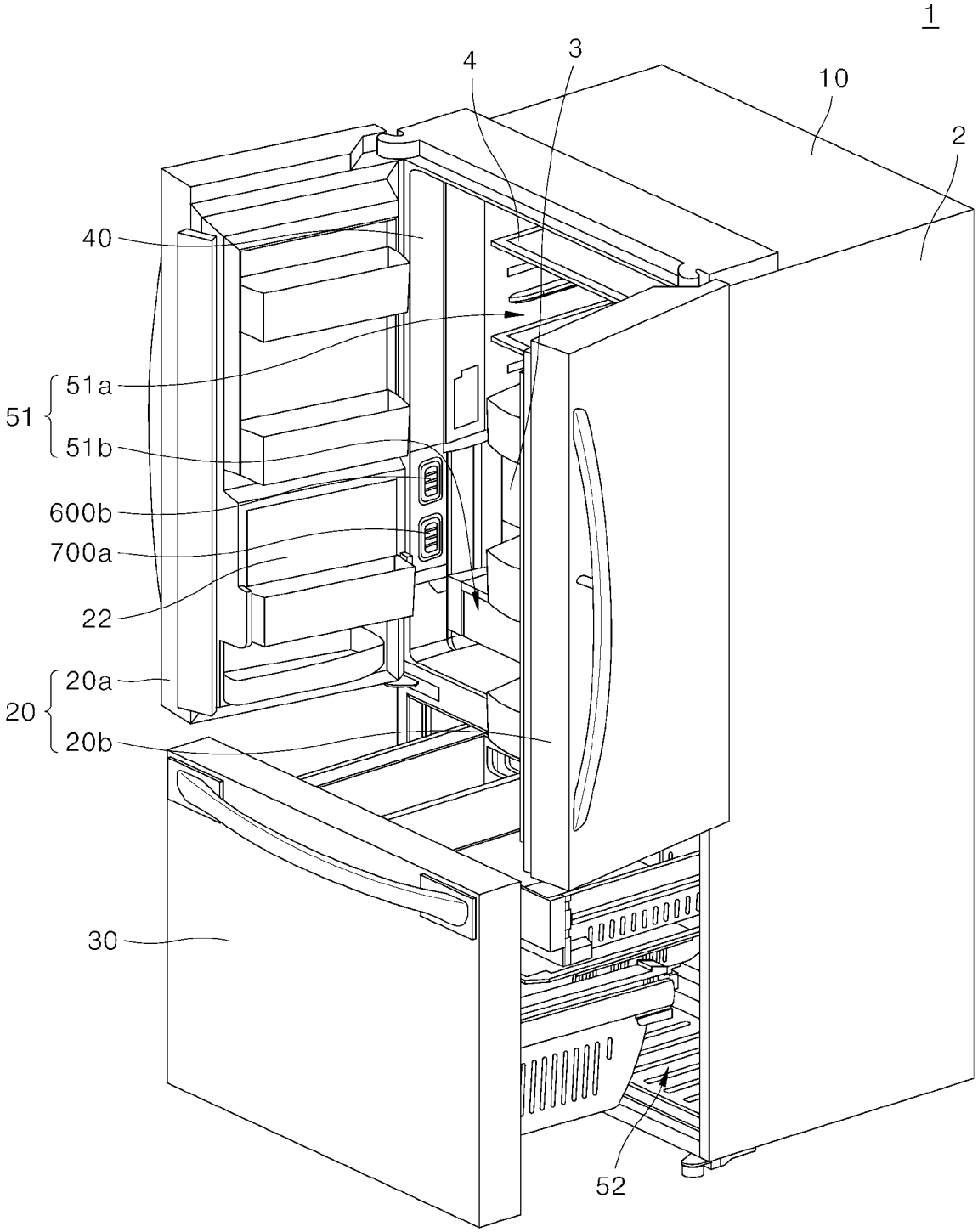
FIG. 2 is a front perspective view showing a state where a door of a refrigerator is open.

FIGS. 1A and 1B are front perspective views showing a state where a door of a refrigerator including an ice-making chamber is closed and a state where a door of a refrigerator including no ice-making chamber is closed. FIG. 2 is a front perspective view showing a state where a door of a refrigerator is open.

An exterior design of the refrigerator 1 may be defined by a cabinet 1 defining a storage space and a door configured to open and close an open front of the cabinet 2.

The cabinet 2 may include an outer case 10 forming an outer surface of the refrigerator 1 and an inner case 40 forming an inner surface of the outer case 10.

The outer case 10 and the inner case 40 may be spaced a preset distance apart from each other and an insulating material is foamed in the space between them to fill the empty space with the insulating material.

A storage space inside the cabinet 2 may be divided into a plurality of spaces, which are a refrigerator compartment 51 and a freezer compartment 52.

As one embodiment of the present disclosure, the freezer compartment 52 may be mounted in a lower space of the cabinet 2 and the refrigerator compartment 51 may be mounted in an upper space.

A door may be coupled to a front surface of the cabinet 2 to open and close the refrigerator 1.

An upper door 20 may be coupled to a front surface corresponding to the refrigerator compartment 51 and a lower door 30 may be coupled to a front surface corresponding to the freezer compartment 52.

For example, the upper door 20 may be a rotation type configured of a first upper door 20 and a second upper door 20*b* that are rotatable on shafts on both sides of the cabinet 2, respectively.

The lower door 30 may be a drawer type configured to slide inward or outward along a rail.

Referring to FIG. 1A, a dispenser 21 may be disposed in the first upper door 20*a* and configured to discharge water or ice even when the door is not opened.

Referring to FIG. 2, an ice-making chamber 22 may be disposed in the first upper door 20*a* in which the dispenser 21 is provided, and may be configured to make ice.

On an inner surface of the inner case 40 connected to the first upper door 20*a* may be formed an ice-making chamber cold air supply outlet hole 600*b* for supply cold air to the ice-making chamber 22 and an ice-making cold air returning inlet hole 700*a* for returning cold air from the ice-making chamber 22.

The ice-making chamber cold air supply outlet hole 600*b* and the ice-making cold air returning inlet hole 700*a* may be in communication with one surface of the ice-making chamber 22, in a state where the first upper door 20*a* is closed.

The refrigerator compartment 51 may be divided into a first storage chamber 51*a* and a second storage chamber 51*b*.

The second storage chamber 51*b* may be a pantry room that may control the temperature to accommodate a specific storage target such as vegetables or meat.

The first storage chamber 51*a* may refer the other space of the refrigerator compartment 51, except the second storage chamber 51*b*, and may be a main storage space.

For example, the second storage chamber 51*b* may be disposed below the first storage chamber 51*a*, and may be partitioned off as a separate space from the first storage chamber 51*a* by a partitioning member.

A storage drawer 3 may be provided in the second storage chamber 51*b* and configured to slide outward and inward along a rail.

In addition, a storage drawer 3 or a shelf 4 may be provided in the first storage chamber 51*a* to easily keep or preserve fresh storing targets. Separate temperature sensors may be provided in the first storage chamber 51*a* and the second storage chamber 51*b*, respectively, and configured to independently adjust and keep different temperatures.

[Cold Air Supply System and Connection Relation Between Components]

Figure 3:
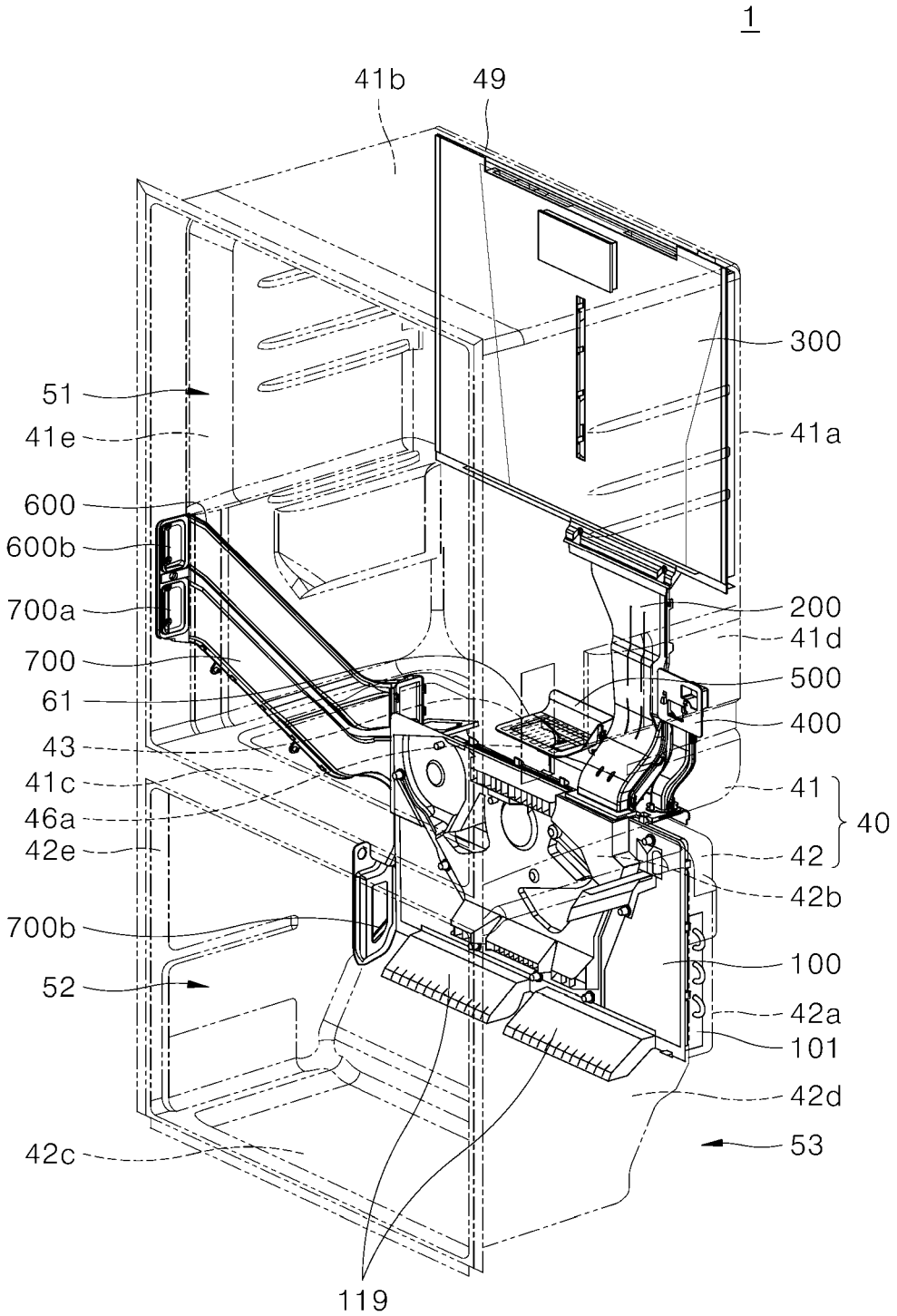
FIGS. 3 and 4 are front and rear perspective views showing a state where an inner case, various ducts and a grille fan assembly are coupled to each other.
Figure 4:
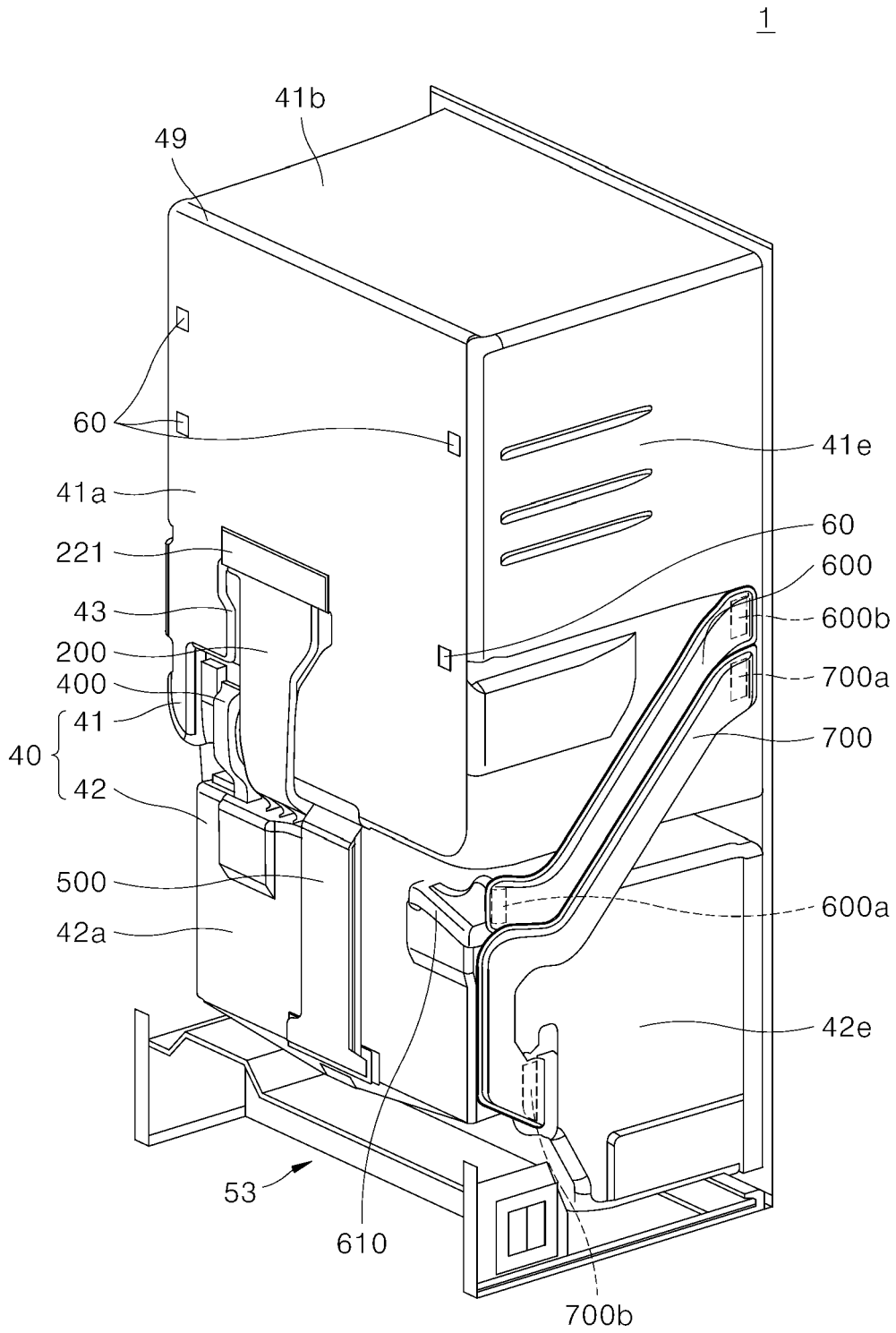
Figure 5:
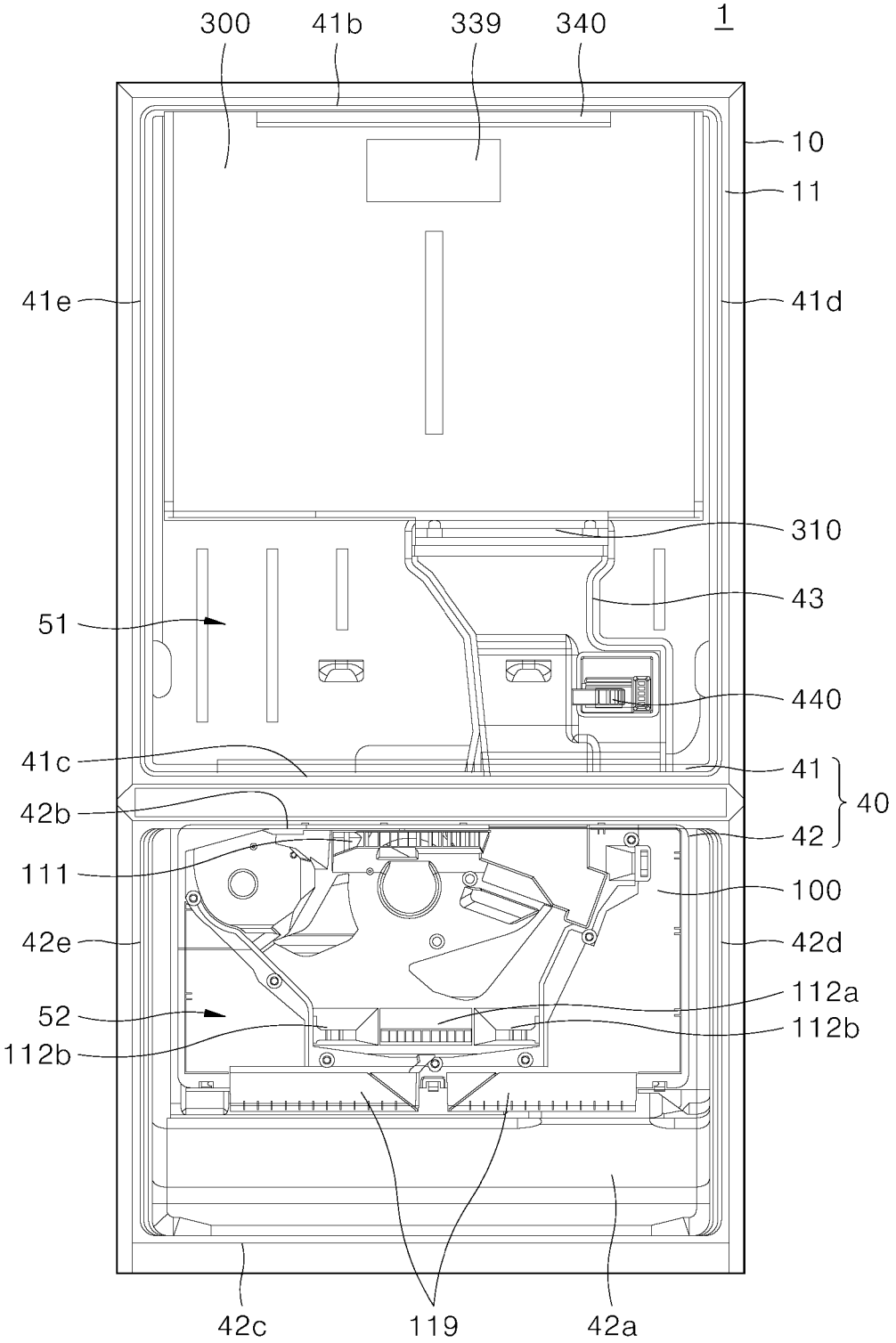
FIG. 5 is a front view of a refrigerator including a grille fan assembly and a refrigerator compartment cold air duct.

Hereinafter, referring to FIGS. 3 to 5, a new cold air supply system formed by coupling the inner case, various ducts and a grille fan assembly to each other and the connection relation between them will be described.

The inner case 40 may include a refrigerating case 41 disposed in an upper area and constituting the refrigerator compartment 51, and a freezing case 42 disposed in a lower area and constituting the freezer compartment 52.

The refrigerating case 41 may have a box shape having an open front surface, and a rear surface 41*a*, an upper surface 41*b*, a lower surface 41*c*, a lateral surface 41*d* and the other lateral surface 42*e* that are closed.

The freezing case 42 may also have a box shape having an open front surface, and a rear surface 42*a*, an upper surface 42*b*, a lower surface 42*c*, a lateral surface 42*d* and the other lateral surface 42*e* that are closed.

The cold air generated by one evaporator 101 may be supplied both of the refrigerator compartment 51 and the freezer compartment 52.

When the ice-making chamber 22 is additionally provided in the upper door 20 of the refrigerator 1, the cold air generated by one evaporator 101 may be supplied to all of the refrigerator compartment 51, the freezer compartment 52 and the ice-making chamber 22.

The evaporator 101 for generating cold air may be disposed inside the freezer compartment 52, specifically, on a rear surface 42*a* of the freezing case 42.

The evaporator 101 may be disposed in an upper area of a mechanical chamber 53.

A grille fan assembly 100 configured to blow the cold air generated by the evaporator 101 to the refrigerator compartment 51 and the freezer compartment 52 may be disposed on a front surface of the evaporator 101.

When the ice-making chamber 22 is provided in the upper door 20 of the refrigerator 1, the cold air generated by one evaporator 101 may be blown from one grille fan assembly 100 to all of the refrigerator compartment 51, the freezer compartment 52 and the ice-making chamber 22.

To blow cold air to a refrigerator compartment cold air supply duct 300, a connection duct 200 may be further provided between the grille fan assembly 100 and the refrigerator compartment cold air supply duct 300.

One end of the connection duct 200 may be connected to the grille fan assembly 100 and the other end of the connection duct 200, so that the cold air blown from the grille fan assembly 100 may be guided to the refrigerator compartment cold air supply duct 300.

Specifically, the other end of the connection duct 200 may be coupled to a refrigerator compartment cold air supply connecting portion 310 extended downward from the refrigerator compartment cold air supply duct 300.

A rear extended portion 221 may be provided on an upper surface of the connection duct 200. The rear extended portion 221 may be extended from a rear end of the upper surface of the connection duct 200 in a vertical direction.

The rear extended portion 221 may be configured to support the rear surface 41*a* of the refrigerating case.

The refrigerator compartment cold air supply duct 300 may be disposed on an inner surface the refrigerating case 41, and the connection duct 200 may be disposed on an outer surface of the refrigerating case 41. The refrigerator compartment cold air supply duct 300 and the connection duct 200 may be in communication at a rear surface 41*a* of the refrigerating case.

A duct inserting groove 49 may be provided along an area in which the upper surface 41*b* meets the rear surface 41*a* of the refrigerating case.

The duct inserting groove 49 may be formed in a protrusion shape protruding upward, viewed above the upper surface 41*b* of the refrigerating case, or a concave shape recessed upward, viewed below the upper surface 41*b* of the refrigerating case.

Some of an upper region of the refrigerator compartment cold air supply duct 300 may be inserted in the duct inserting groove 49 to be strongly secured by face-to-face contact.

A refrigerator compartment cold air main outlet hole 340 for discharging the cold air generated by the evaporator 101 disposed in the freezer compartment toward the front surface of the refrigerator compartment 51 may be formed in the upper region of the refrigerator compartment cold air supply duct 300/

A refrigerator compartment cold air auxiliary outlet guide 339 configured to discharge cold air to the refrigerator compartment 51 may be formed below the cold air main outlet hole 340 to circulate the cold air in the entire area of the refrigerator compartment 51.

The refrigerator compartment cold air supply duct 300 may be secured to the rear surface 41*a* of the refrigerating case through a plurality of coupling through-holes 40 formed in the rear surface 41*a* of the refrigerating case, that corresponds to the area where the refrigerator compartment cold air supply duct 300 is disposed, by using a separate coupling member.

An insulating material 11 may be foamed in a space between the inner case 40 and the outer case 10 to fill in the space.

The connection duct 200 may be embedded in the space between the inner case 40 and the outer case 10 by passing through the space foamed and filled with the insulating material 11.

A rear projected portion 43 protruding to the inside of the refrigerating case 41 may be provided on a rear surface 41*a* of the refrigerating case so that at least predetermined area of the connection duct 200 may be inserted from the outside of the refrigerating case 41.

Since the connection duct 200 is disposed on a rear surface of the rear projected portion 43, the connection duct 200 may be disposed on an outer surface not an inner surface of the refrigerating case 41.

Accordingly, an additional area protruding toward the inside of the refrigerating case 41 except the rear projected portion 43 may be reduced up to the height of the rear projected portion 43 in which the connection duct 200 is inserted, so that the inner volume of the refrigerating case 41 may be increased by that much.

The refrigerator 1 according to the present disclosure may include a refrigerator compartment cold air returning duct configured to return and supply the cold air of the refrigerator compartment to the evaporator 101.

The refrigerator compartment cold air returning duct 500 may have one end connected to the freezer compartment 52 and the other end connected to the refrigerator compartment 51. The both ends of the refrigerator compartment cold air returning duct 500 may overlap with each other in a vertical direction.

One end of the refrigerator compartment cold air returning duct 500 may be configured to communicate with the freezer compartment 52 through a refrigerator compartment returning communication outlet hole 46*b*.

The refrigerator compartment cold air returning duct 500 may pass through the rear surface of the evaporator 101.

The refrigerator compartment returning duct 500 may be configured to return the cold air circulating after supplied to the refrigerator compartment 51 to the freezer compartment 52.

The refrigerator compartment 51 may be divided into a first storage chamber 51*a* and a second storage chamber 51*b*.

A second storage chamber cold air supply duct 400 may be configured to supply cold air to the second storage chamber 51*b*, and the second storage cold air supply duct 400 may be disposed on the outer surface of the refrigerating case 41.

The heat insulating material 11 may be foamed and filled in the space between the inner case 40 and the outer case 10.

The second storage chamber cold air supply duct 400 may be disposed to pass through the space foamed and filled with the insulating material 11, to be embedded in the space between the inner case 40 and the outer case 10.

the rear projected portion 43 projected inward of the refrigerating case 41 may be provided on the rear surface 41*a* of the refrigerating case in order to receive at least predetermined area of the connection duct 200 from the outside of the refrigerating case 41.

In this instance, the rear projected portion 43 may be formed in a shape capable of receiving the at least predetermined area of the second storage chamber cold air supply duct 400 in addition to the shape capable of receiving the connection duct 200.

The connection duct 200 and the second storage chamber cold air supply duct 400 may be disposed adjacent to each other.

A second storage chamber cold air outlet cover 440 may be provided on a front surface of the other end of the second storage chamber cold air supply duct 400 connected to the second storage chamber 51*b*.

The second storage chamber cold air outlet cover 440 may be disposed inside the refrigerating case 41.

The refrigerator 1 according to the present disclosure may include the ice-making chamber 22 provided in the upper door 20 configured to open and the close the refrigerator compartment 51.

The cold air generated by the evaporator 101 may be supplied to the ice-making chamber 22 through an ice-making chamber cold air supply duct 600.

An ice-making chamber cold air supply inlet hole 600*a* may be formed in one end of the ice-making chamber cold air supply duct 600 to be in communication with the grille fan assembly 100 through an ice-making chamber cold air supply communication inlet hole 47*a* of the freezing case 42.

In this instance, an ice-making cold air guide duct 610 may be disposed between the ice-making chamber cold air supply duct 600 and the grille fan assembly 100 to facilitate communication between the cold air supply duct 600 and the grille fan assembly 100.

The ice-making chamber cold air supply duct 610 may be configured to switch a direction of the cold air discharged from the grille fan assembly 100.

The other end of the ice-making chamber cold air supply duct 600 may be in communication with the ice-making chamber 22 through the ice-making chamber cold air supply communication outlet hole 600*b* formed on the other surface 41*e* of the refrigerating case.

The cold air circulated in the ice-making chamber 22 may return to the freezer compartment 52 through an ice-making chamber cold air returning duct 700.

An ice-making chamber cold air returning outlet hole 700*b* may be formed in one end of the ice-making chamber cold air returning duct 700, to discharge the cold air returning from the ice-making chamber 22 to the freezer compartment 52 by communication with the other lateral surface 42*e* of the freezing case.

The cold air discharged to the freezer compartment 52 after returning from the ice-making chamber 22 may return again to a freezer compartment cold air returning guide 119 disposed on a lower surface of the grille fan assembly 100.

An ice-making returning inlet hole 700*a* may be formed in the other end of the ice-making chamber cold air returning duct 700 to communicate with one lateral surface of the ice-making chamber 22 in a state where the first upper door 20*a* is closed.

[Grille Fan Assembly]

Hereinafter, referring to FIGS. 6A to 15, the grille fan assembly 100 will be described in detail.

The grille fan assembly 100 according to the present disclosure may include a shroud 120 and a grille fan assembly wall 110.

The shroud 120 may define a rear exterior design of the grille fan assembly 100 and the grille fan assembly wall 110 may define a front exterior design of the grille fan assembly 100.

The grille fan assembly wall 110 may be disposed toward the front surface of the freezer compartment 52, and the shroud 120 may be disposed toward the rear surface 42*a* of the freezing case, that is, the evaporator 101 provided on the rear wall of the freezing case.

The shroud 120 may include a first inlet hole 121*a* and a second inlet hole 121*b*.

The cold air heat-exchanged while passing through the evaporator 101 disposed behind the shroud 120 may flow into the space formed between the first inlet hole 121*a* and the second inlet hole 121*b*.

A freezing fan module 160 is disposed on a front surface of the first inlet hole 121*a* and an ice-making fan 170 may be disposed on a front surface of the second inlet hole 121*b*.

The first inlet hole 121*a* may be provided in an upper center region of the grille fan assembly 100 and the second inlet hole 121*b* may be provided in one side region of the grille fan assembly 100 with respect to the first inlet hole 121*a*.

Since the ice-making fan module 170 is disposed the second inlet hole 121*b* to supply cold air to the ice-making chamber 22, the second inlet hole 121*b* may be disposed adjacent to the other lateral surface 42*e* of the freezing case where the ice-making chamber cold air supply duct 600 is provided.

A flow path opening/closing module surface seating portion 122*a* and a second flow path opening/closing module seating portion 122*b* may be formed on the other lateral surface rather than one lateral surface on which the second inlet hole 121*b* is formed with respect to the first inlet hole 121*a*.

The first flow path opening/closing module surface seating portion 122*a* and the second flow path opening/closing module seating portion 122*b* may be formed in a shape projected toward the rear surface of the shroud 120.

The first flow path opening/closing module surface seating portion 122*a* and the second flow path opening/closing module seating portion 122*b* may be disposed in order in a direction getting farther from the first inlet hole 121.

Accordingly, the first flow path opening/closing module surface seating portion 122*a* may be disposed between the first inlet hole 121*a* and the second flow path opening/closing module seating portion 122*b*.

The second flow path opening/closing may have a shape projected more toward the rear surface of the shroud 120 than the first flow path opening/closing module surface seating portion 122*a*.

The shroud 120 may primarily have a step in an area from the first inlet hole 121*a* to the first flow path opening/closing module surface seating portion 122*a*, and may secondarily have a step in an area from the first flow path opening/closing module surface seating portion 122*a* to the second flow path opening/closing module seating portion 122*b*.

Accordingly, steps may be formed from the first inlet hole 121*a* to the first flow path opening/closing module surface seating portion 122*a* and the second flow path opening/closing module seating portion 122*b*.

The grille fan assembly wall 110 disposed on the front surface of the shroud 120 may be coupled to the shroud 120 to accommodate an ice-making fan module 170, the freezing fan module 160 and the flow path opening/closing module 130.

A grille fan upper region outlet hole 111 may be formed in an upper center region of the grille fan assembly wall 110 and configured to discharge the cold air blown by the freezing fan module 160 toward an upper front surface of the freezer compartment 52.

In this instance, some of the cold air blown by the ice-making fan module 170 may be discharged to the freezer compartment 52 through the grille fan upper region outlet hole 111.

A grille fan lower region outlet hole 112*a* and 112*b* may be formed in a lower center region of the grille fan assembly wall 110 to discharge the cold air blown by the freezing fan module 160 toward a lower front surface of the freezer compartment 52.

The grille fan lower region outlet hole 112 may be provided with a first grille fan lower region outlet hole 112*a* and a pair of second grille fan lower region outlet holes 112*b* disposed on both lateral surfaces with respect to the first grille fan lower region outlet hole 112*a*.

The second grille fan lower region outlet hole 112*b* may guide the cold air discharged to the freezer compartment 52 to flow to the both lateral surfaces to uniformly circulate the overall region of the freezer compartment 52.

A pair of freezer compartment cold air returning guides 119 may be formed below the grille fan lower region outlet holes 112*a* and 112*b* to guide the returning cold air.

The cold air having circulated the ice-making chamber 22 and the cold air having circulated the freezer compartment 52 may return to the freezer compartment cold air returning guide 119 provided in the lower region of the freezer compartment 52 to be supplied to the evaporator 101.

A second flow path opening/closing module opposite surface seating portion 113 facing the area of the shroud 120 where the first flow path opening/closing module surface seating portion 122*a* and the second flow path opening/closing module seating portion 122*b* are disposed may be formed in one lateral surface of the grille fan upper region outlet hole 111 of the grille fan assembly wall 110.

The first flow path opening/closing module opposite surface seating portion 113 may have a shape projected toward the front surface of the grille fan assembly wall 110.

The grille fan assembly wall 110 may have a step in an area from the grille fan upper region outlet hole 111 to the first flow path opening/closing module opposite surface seating portion 113.

Accordingly, one surface of the flow path opening/closing module 130 may be seated on the first flow path opening/closing module opposite surface seating portion 113, and the other surface thereof may be seated on the first flow path opening/closing module surface seating portion 122*a* and the second flow path opening/closing module seating portion 122*b*, to be secured to the grille fan assembly 100.

The flow path opening/closing module 130 may include a flow path opening/closing damper 140 and 150 configured to selectively cut off the cold air supplied to the refrigerator compartment 51.

The refrigerator compartment 51 may include a first storage chamber 51*a* and a second storage chamber 51*b* that are preset to have different temperatures, respectively.

In this instance, the flow path opening/closing module 130 may include a first flow path opening/closing damper 140 for selectively cutting off the cold air supplied to the first storage chamber 51*a* and a second flow path opening/closing damper 150 for selectively cutting off the cold air supplied to the second storage chamber 51*b*.

The first chamber flow path opening/closing damper 140 and the second flow path opening/closing damper 150 may be seated on the flow path opening/closing module seating portion 122*a* and 122*b*, in a state of being covered by a damper cover 131.

The damper cover 131 may be formed of an insulating material such as Styrofoam, and the material is not limited thereto.

The damper cover 131 may be formed by coupling a first damper cover 131*a*, a second damper cover 131*b* and a third damper cover 131*c* to each other.

The first flow path opening/closing damper 140 may be disposed between the first damper cover 131*a* and the second damper cover 131*b*, and the second flow path opening/closing damper 150 may be disposed between the second damper 131*b* and the third damper 131*c*.

The second flow path opening/closing damper 150 may be formed in a relatively smaller size than the first flow path opening/closing damper 140.

The third damper cover 131*c* covering only the second flow path opening/closing damper 150 may be formed in a relatively smaller size than the first damper cover 131*a* and the second damper cover 131*b*.

A first cold air outlet 132*a* may be formed on an upper surface of the damper cover 131 covering the first flow path opening/closing damper 140 to be in communication with the connection duct 200 to supply cold air.

A second cold air outlet 132*b* may be formed on an upper surface of the damper cover 131 covering the second flow path opening/closing damper 150 to be in communication with the second storage chamber cold air supply 400 to supply cold air.

A lower region of the damper cover 131 may be open to supply cold air to the first flow path opening/closing damper 140 and the second flow path opening/closing damper 150.

Accordingly, the damper cover 131 may be configured to cover the first flow path opening/closing damper 140 and the second flow path opening/closing damper 150 except the first cold air outlet hole 132*a* and the second cold air outlet hole 132*b* formed on the upper surface and the open space of the lower region.

According to the present disclosure, since the first flow path opening/closing damper 140 and the second flow path opening/closing damper 150 are disposed in the grille fan assembly 100 of the freezer compartment 52, there might be a problem of in that the dampers 140 and 150 disposed adjacent to the evaporator 101 are frozen to cause a malfunction.

Accordingly, the structure of covering the first flow path opening/closing damper 140 and the second flow path opening/closing damper 150 with the damper cover formed of the insulating material may reduce the problem of the frost caused by the evaporator 101.

Hereinafter, referring to FIGS. 10 to 13, the first flow path opening/closing damper 140 and the second flow path opening/closing damper 150 will be described in detail.

Figure 10A:
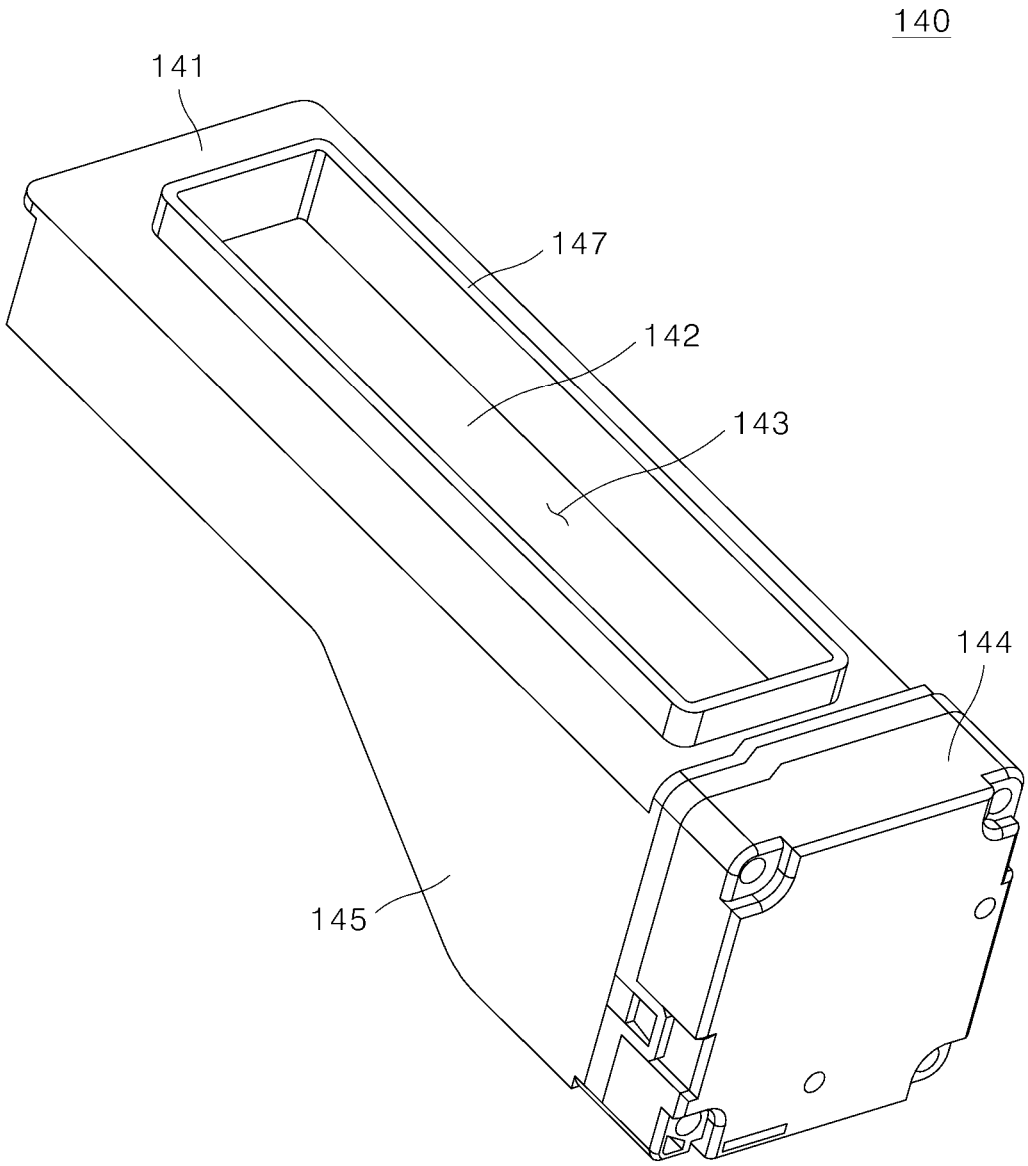
FIGS. 10A and 10B are perspective views showing a state where a first damper door of a first flow path opening/closing damper is closed and a state the first damper door is open.
Figure 10B:
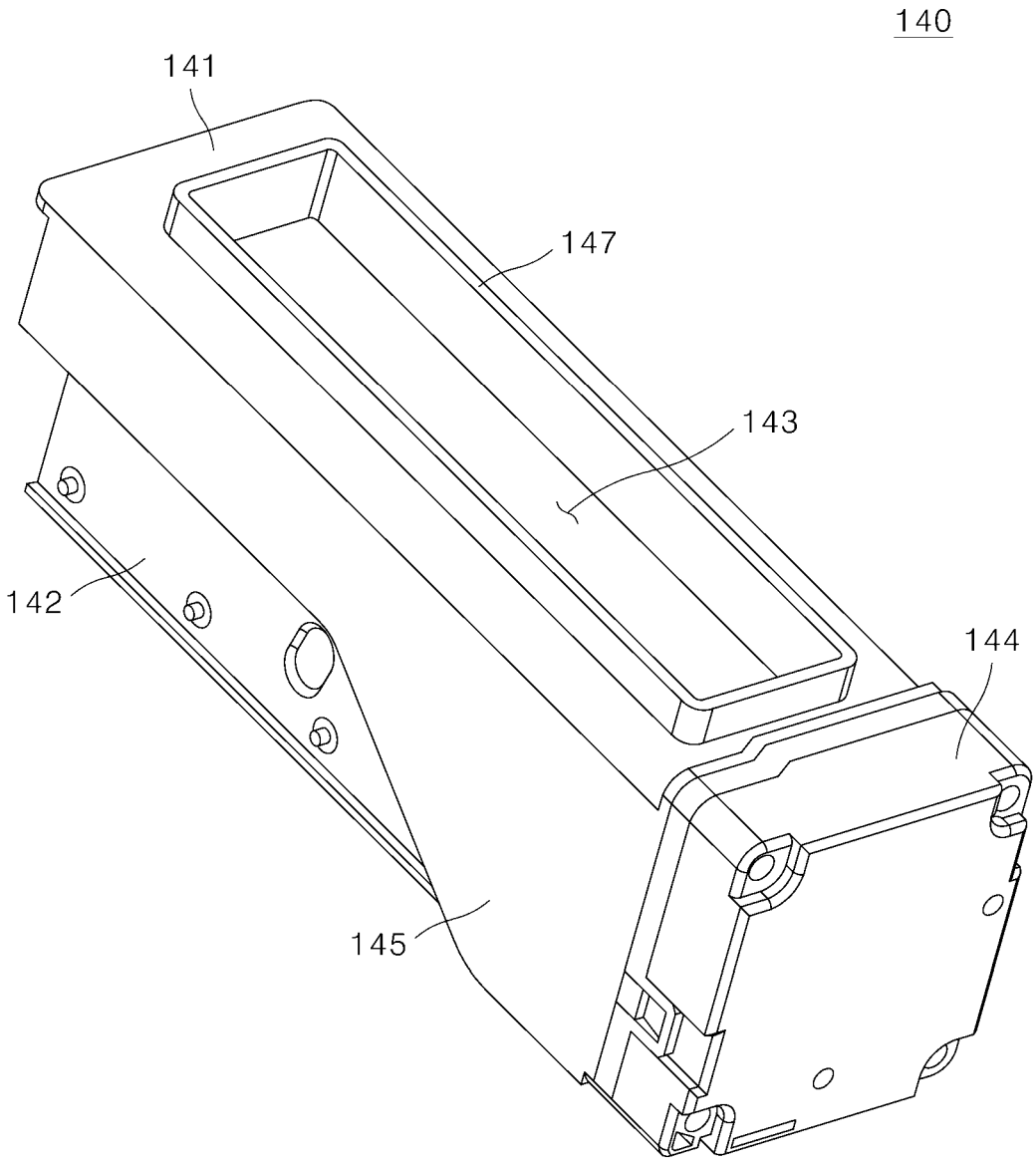

Referring to FIGS. 10A and 10B, the first flow path opening/closing damper 140 may include a first damper case 141, a first damper door 142 and a first damper operation motor 144.

The first damper case 141 may have a square frame structure including a first damper through-hole 132 through which cold air toward the first storage chamber 51*a* passes and which is formed in a center region.

The first damper through-hole 143 may be in communication with the cold air flow path of the grille fan assembly 100 toward the first storage chamber 51*a*.

The first damper door 142 may be coupled to one surface of the first damper case 141 so that the surface of the first damper case 141 may have a flat shape coupled to the first damper door 142 airtight.

A first damper securing guide 147 may be extended upward from the other surface of the first damper case 141 along the first damper through-hole 143.

The first damper securing guide 147 may be configured to guide the direction of the cold air passing through the first damper through-hole 143.

A first damper blocking portion 145 may be formed on one surface of the first damper case 141.

The first damper blocking portion 145 may be configured to adjust a rotation angle of the first damper door 142 so that the first damper door 142 may not be open excessively.

The first damper blocking portion 145 may be formed by extending some area along a periphery of one surface of the first damper case 141.

The first damper blocking portion 145 may be disposed in a direction in which the first damper door 142 rotates to block the first damper door 142 from rotating excessively.

Figure 12A:
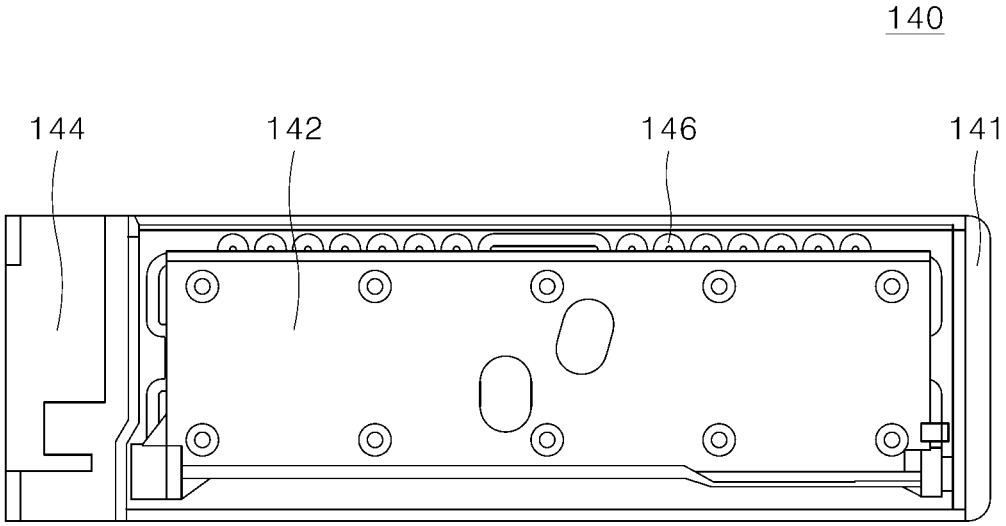
FIGS. 12A and 12B are bottom views showing a state where a first damper door of a first flow path opening/closing damper is closed and a state the first damper door is open.
Figure 12B:
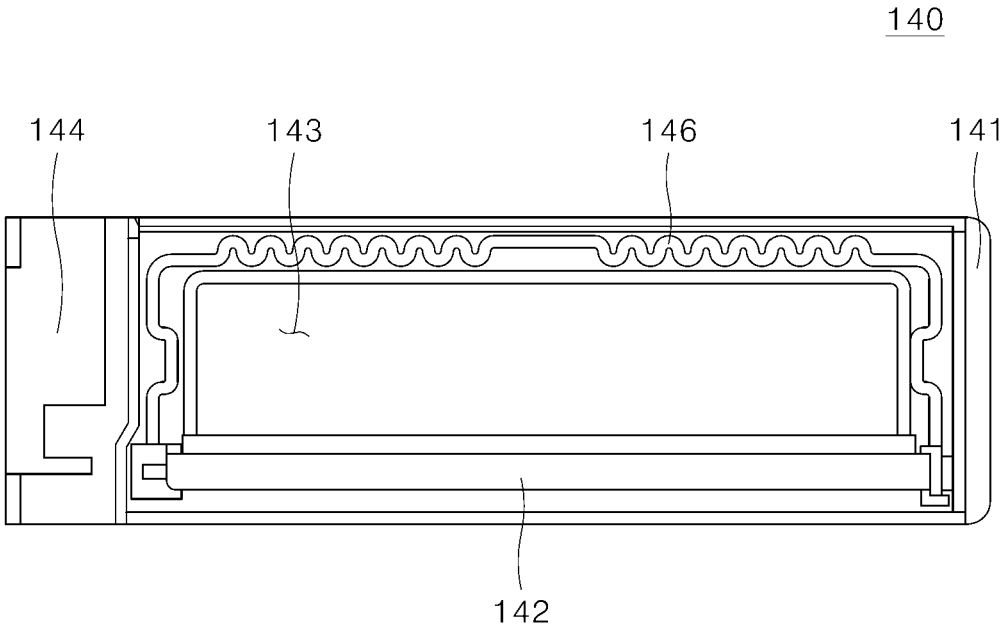

Referring to FIGS. 12A and 12B, a first damper hot wire 146 may be formed on one surface of the first damper case 141 along a periphery of the first damper through-hole 143.

To increase the area in which the first damper hot wire 146 is formed, the first damper hot wire 146 may be formed in a pattern having curved portions as many as possible.

The position of the first damper hot wire 146 may be provided in an area in which the first damper case 141 and the first damper door 142 are in direct contact with each other.

Since the first flow path opening/closing damper 140 is disposed in the freezer compartment 52, there may occur a problem in that the first damper door 142 is frozen due to the evaporator 101 of the freezer compartment 52 only not to operate properly.

The frozen area of the first damper door 142 may mostly occur in the region in contact with the first damper case 141. Because of that, when the first damper door 142 is not operated by the frozen area, a defrost process for applying heat to the first damper hot wire 146 may be performed to solve the problem of the frozen door.

The first damper door 142 may be coupled to one surface of the first damper case 141.

The first damper door 142 may be configured to selectively block the cold air from passing through the first damper through-hole 143.

Accordingly, when blocking the cold air, the first damper door 142 may block the first damper through-hole 143 by contacting with one surface of the first damper case 141. When allowing the passage of the cold air, the first damper door 142 may rotate in one direction to open the first damper through-hole 143.

The peripheral area of the first damper door 142 may have a wider area than the first damper through-hole 143 to contact with the first damper door 142. Accordingly, the cold air may be effectively blocked when the first damper door 142 is closed.

A first damper operation motor 144 may be disposed in a predetermined area of the first damper case 141.

The first damper operation motor 144 may be configured to control whether to rotate the first damper door 142.

A motor shaft of the first damper operation motor 144 may be coupled to a rotation hinge shaft of the first damper door 142 to control the rotation of the first damper door 142.

Figure 11A:
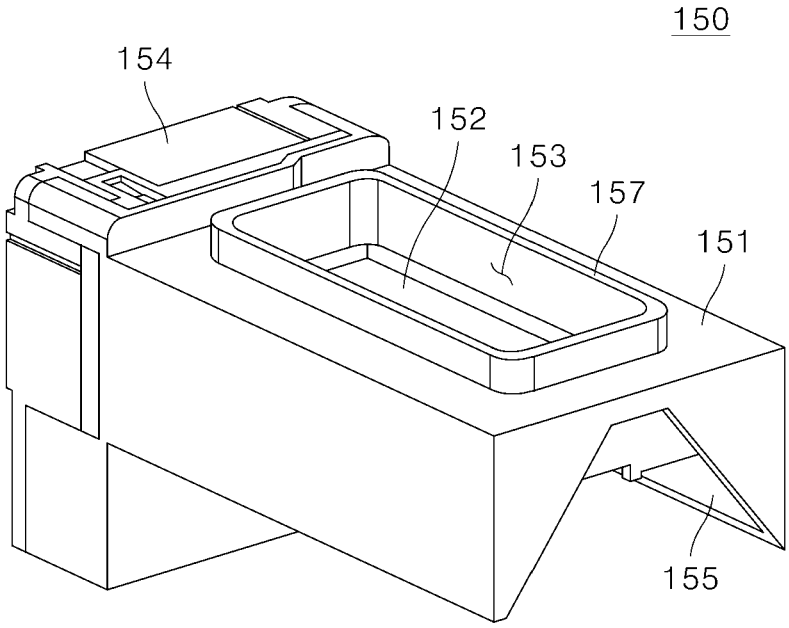
FIGS. 11A and 11B are perspective views showing a state where a second damper door of a second flow path opening/closing damper is closed and a state the second damper door is open.
Figure 11B:
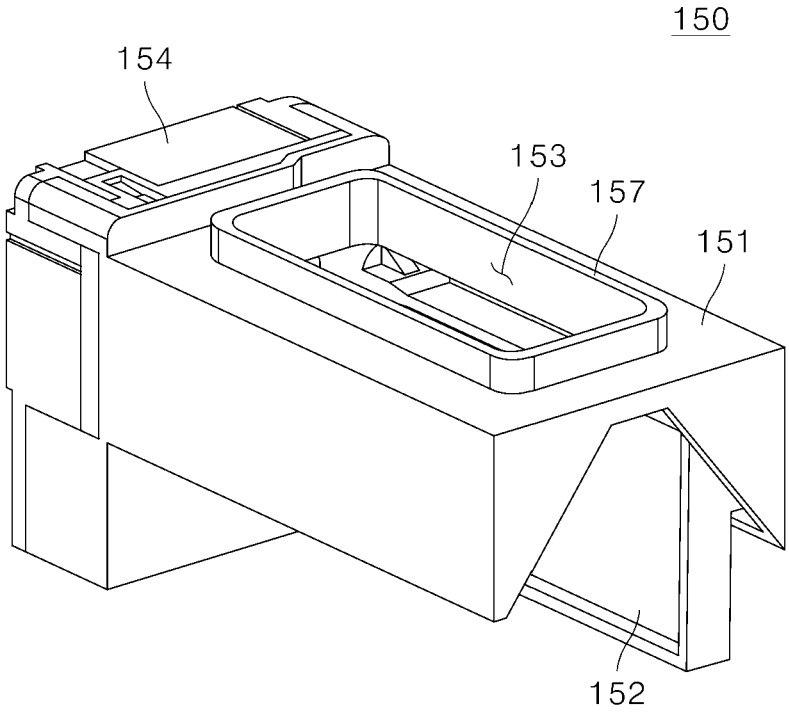

Referring to FIGS. 11A and 11B, the second flow path opening/closing damper 150 may include a second damper case 151, a second damper door 152 and a second damper operation motor 154.

The second damper case 151 may have a square frame structure including a second damper through-hole 153 through which cold air toward the second storage chamber 51*b* passes and which is formed in a center region.

The second damper through-hole 153 may be in communication with the cold air flow path of the grille fan assembly 100 toward the second storage chamber 51*b*.

The second damper door 152 may be coupled to one surface of the second damper case 151 so that the surface of the second damper case 151 may have a flat shape coupled to the second damper door 152 airtight.

A second damper securing guide 157 may be extended upward from the other surface of the second damper case 151 along the second damper through-hole 153.

The second damper securing guide 157 may be configured to guide the direction of the cold air passing through the second damper through-hole 153.

A second damper blocking portion 155 may be formed on one surface of the second damper case 151.

The second damper blocking portion 155 may be configured to adjust a rotation angle of the second damper door 152 so that the second damper door 152 may not be open excessively.

The second damper blocking portion 155 may be formed by extending some area along a periphery of one surface of the second damper case 151.

The second damper blocking portion 155 may be disposed in a direction in which the second damper door 152 rotates to block the second damper door 152 from rotating excessively.

Figure 13A:
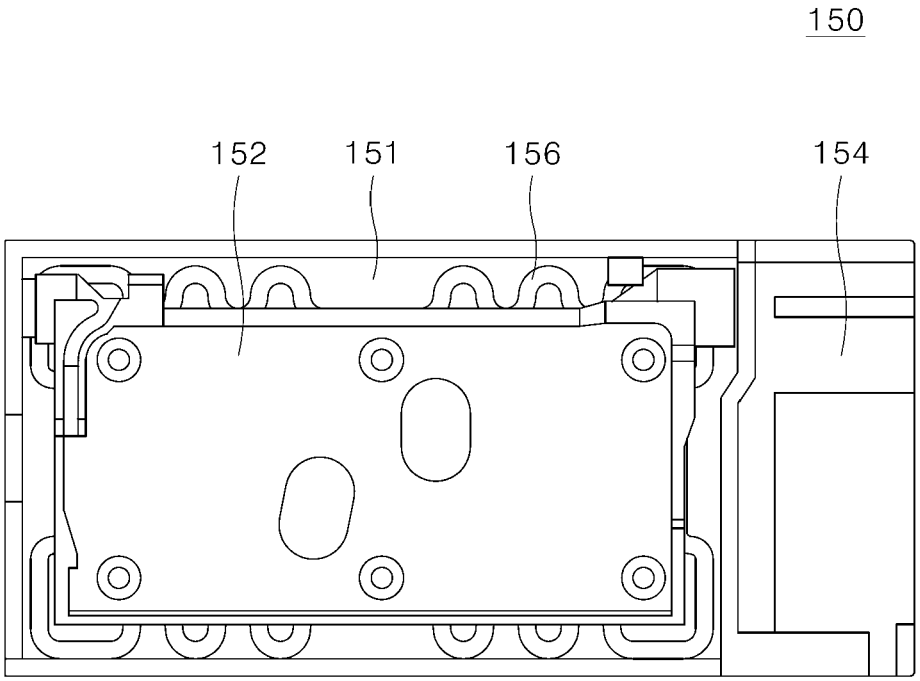
FIGS. 13A and 13B are bottom views showing a state where a second damper door of a second flow path opening/closing damper is closed and a state the second damper door is open.
Figure 13B:
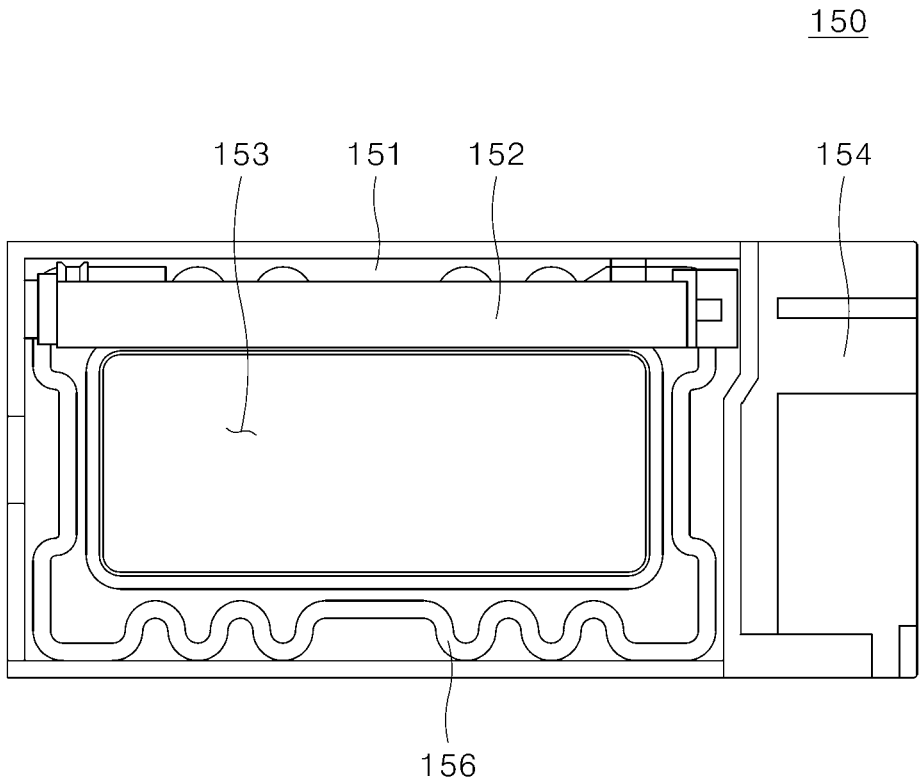
Figure 14A:
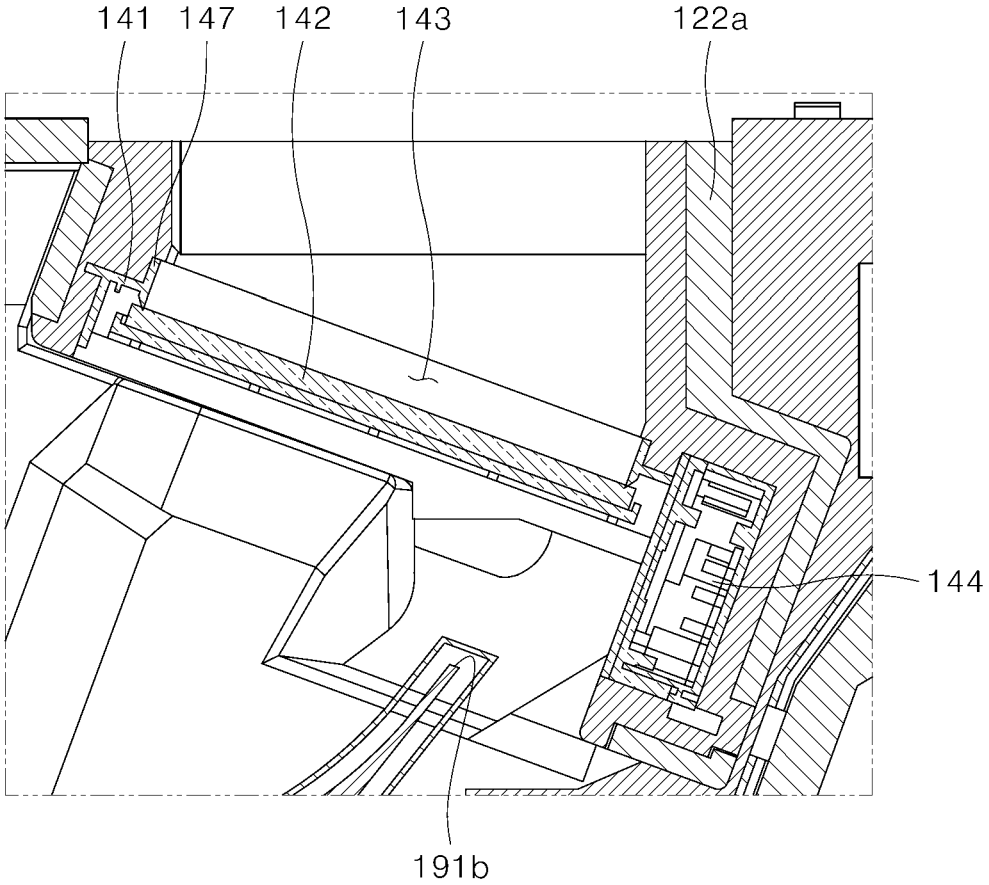
FIGS. 14A and 14B are sectional views of a first flow path opening/closing damper and a second flow path opening/closing damper, that are disposed in a shroud, in a front direction.
Figure 14B:
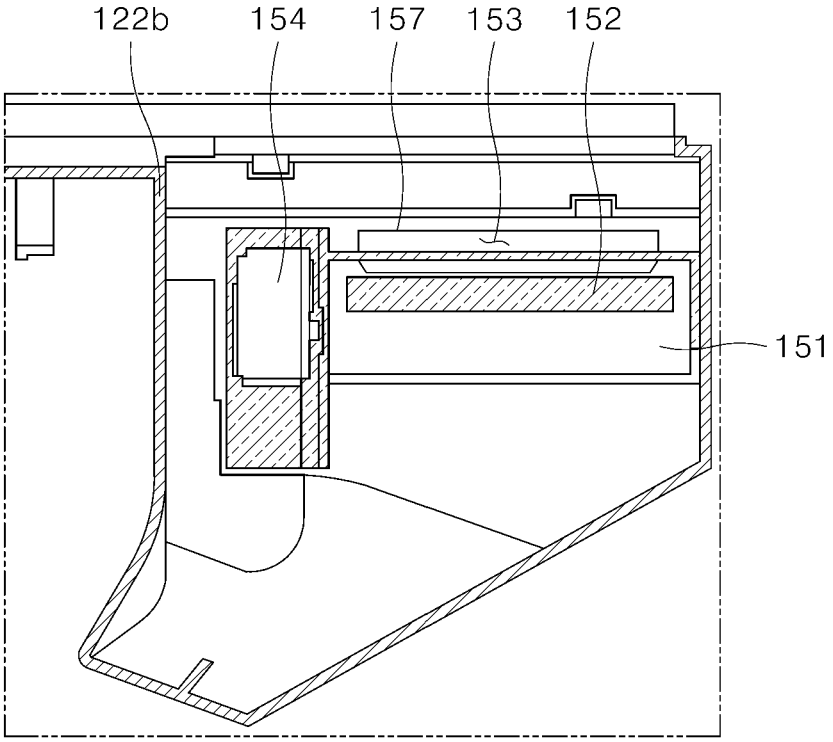
Figure 15:
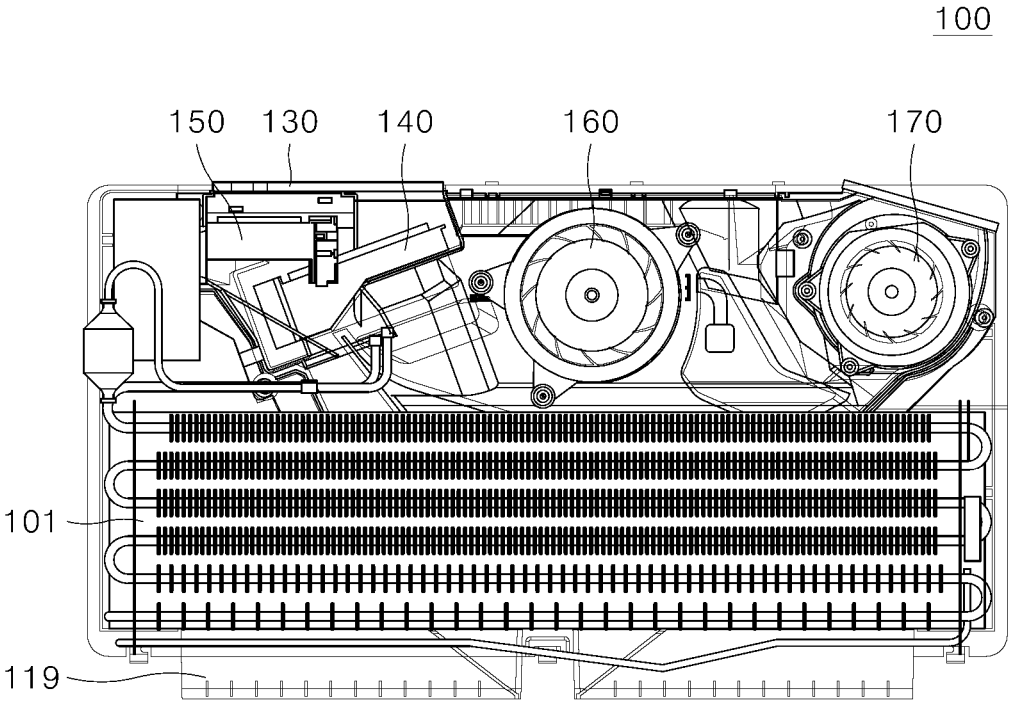
FIG. 15 is a rear view of an evaporator that is disposed on a rear surface of a grille fan assembly.

Referring to FIGS. 13A and 13B, a second damper hot wire 156 may be formed on one surface of the second damper case 151 along a periphery of the second damper through-hole 153.

To increase the area in which the second damper hot wire 156 is formed, the second damper hot wire 156 may be formed in a pattern having curved portions as many as possible.

The position of the second damper hot wire 156 may be provided in an area in which the second damper case 151 and the second damper door 152 are in direct contact with each other.

Since the second flow path opening/closing damper 150 is disposed in the freezer compartment 52, there may be a problem in that the second damper door 152 is frozen due to the evaporator 101 of the freezer compartment 52 only not to operate properly.

The frozen area of the second damper door 152 may mostly occur in the region in contact with the second damper case 151. Because of that, when the second damper door 152 is not operated by the frozen area, a defrost process for applying heat to the second damper hot wire 156 may be performed to solve the problem of the frozen door.

The second damper door 152 may be coupled to one surface of the second damper case 151.

The second damper door 152 may be configured to selectively block the cold air from passing through the second damper through-hole 153.

Accordingly, when blocking the cold air, the second damper door 152 may block the second damper through-hole 153 by contacting with one surface of the second damper case 151. When allowing the passage of the cold air, the second damper door 152 may rotate in one direction to open the second damper through-hole 153.

The peripheral area of the second damper door 152 may have a wider area than the second damper through-hole 153 to contact with the second damper door 152. Accordingly, the cold air may be effectively blocked when the second damper door 152 is closed.

A second damper operation motor 154 may be disposed in a predetermined area of the second damper case 151.

The second damper operation motor 154 may be configured to control whether to rotate the second damper door 152.

A motor shaft of the second damper operation motor 154 may be coupled to a rotation hinge shaft of the second damper door 152 to control the rotation of the second damper door 152.

As described above, the first flow path opening/closing damper 140 may have a larger size than the second flow path opening/closing damper 150.

The size of the first damper case 141 of the first flow path opening/closing damper 140 and the size of the first damper through-hole 143 of the first flow path opening/closing damper 140 may be greater than that of the second damper case 151 and that of the second damper through-hole of the second flow path opening/closing damper 150, so that the amount of the cold air passing through the first flow path opening/closing damper 140 may be greater than that of the cold air passing through the second flow path opening/closing damper 150.

Accordingly, the amounts of the cold air supplied to the first storage chamber 51*a* and the second storage chamber 51*b* of the refrigerator compartment, which requires different temperatures, may be adjusted to be different by making the sizes of the first flow path opening/closing damper 140 and the second flow path opening/closing damper 150 be different from each other.

Due to a structure of arranging the first flow path opening/closing damper 140 and the second flow path opening/closing damper 150 which will be described below, the grille fan assembly 100 may efficiently and smoothly adjust the amount of the cold air supplied to the dampers.

Figure 8:
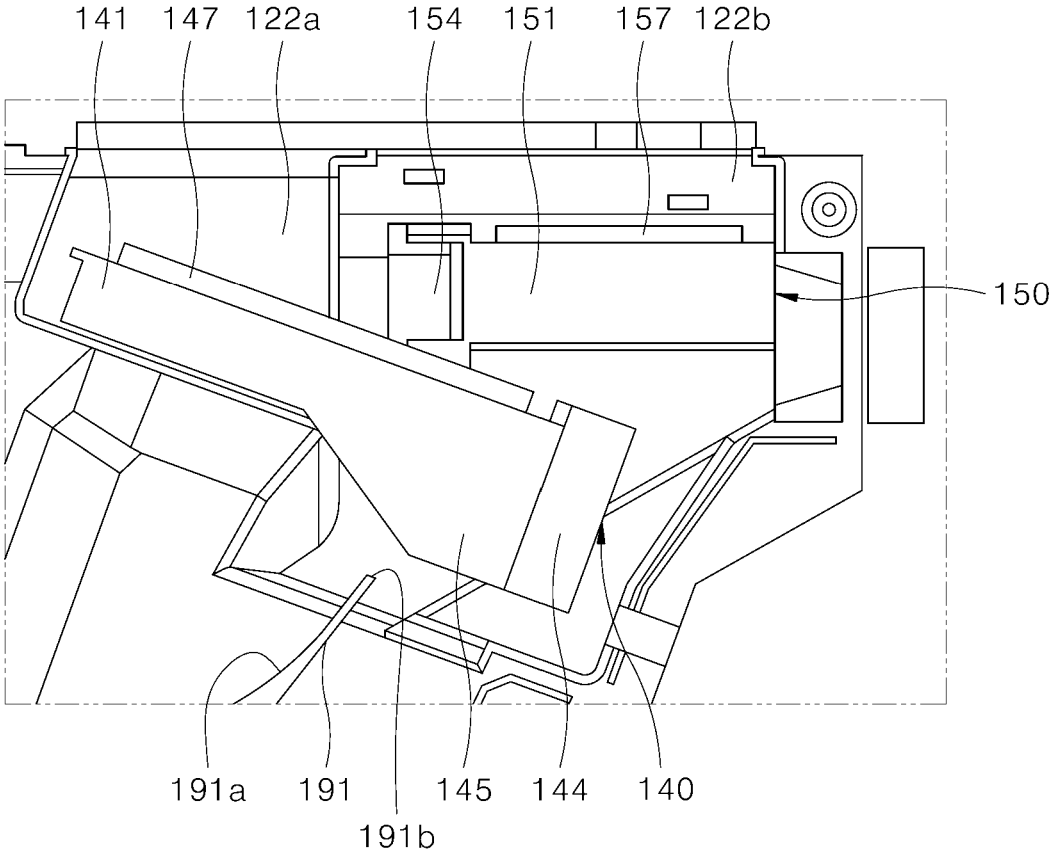
FIG. 8 is an enlarged front view of a first flow path opening/closing damper and a second flow path opening/closing damper that are disposed in a shroud.
Figure 9:
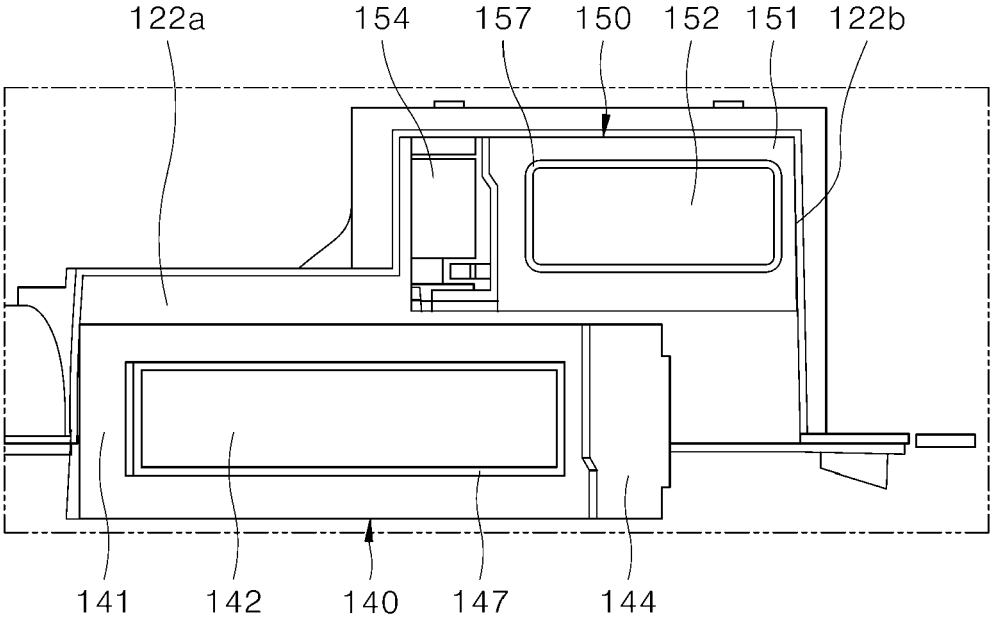
FIG. 9 is an enlarged plane view of a first flow path opening/closing damper and the second flow path opening/closing damper that are disposed in the shroud.

Referring to FIGS. 8 and 9, the first flow path opening/closing damper 140 and the second flow path opening/closing damper 150 may overlap each other in at least predetermined portion in the front-rear direction.

Since at least predetermined area of the first flow path opening/closing damper 140 overlaps with at least predetermined area of the second flow path opening/closing damper 150, the direction of the cold air supplied to the first flow path opening/closing damper may be different from the direction of the cold air supplied to the second flow path opening/closing damper 150, thereby adjusting the amounts of the cold air supplied thereto differently.

Since in the front-rear direction at least predetermined area of the first flow path opening/closing damper 140 overlaps with at least predetermined area of the second flow path opening/closing damper 150, the direction of the cold air supplied to the first flow path opening/closing damper may be different from the direction of the cold air supplied to the second flow path opening/closing damper 150, space utilization may be enhanced even when both the first flow path opening/closing damper 140 and the second flow path opening/closing damper 150 are disposed in the grille fan assembly 100.

In addition, since at least predetermined area of the first flow path opening/closing damper 140 overlaps with at least predetermined area of the second flow path opening/closing damper 150, the direction of the cold air supplied to the first flow path opening/closing damper may be different from the direction of the cold air supplied to the second flow path opening/closing damper 150, the first flow path opening/closing damper 140 and the second flow path opening/closing damper 150 may be arranged at different angles, respectively, with respect to the grille fan assembly 100.

Accordingly, the amounts of the cold air supplied to the dampers 140 and 150 may be adjusted to be different from each other by forming the directions of the cold air supplied to the first and second flow path opening/closing dampers 140 and 150 in different directions.

In addition, since the first flow path opening/closing damper 140 and the second flow path opening/closing damper 150 do not overlap with each other in the left-right direction, the dampers 140 and 150 may not be positioned in the directions of the same cold air flow paths.

Since first flow path opening/closing damper 140 and the second flow path opening/closing damper 150 do not overlap with each other in the up-down direction, the dampers 140 and 150 may not be positioned in the directions of the same cold air flow paths.

Specifically, the first flow path opening/closing damper 140 and the second flow path opening/closing damper 150 may not be disposed on the same plane when a virtual plane is drawn with respect the vertical (up-down) and horizontal (left-right) directions.

As described above, since the first flow path opening/closing damper 140 and the second flow path opening/closing damper 150 may not be disposed on the same plane when a virtual plane is drawn with respect the vertical (up-down) and horizontal (left-right) directions, the first flow path opening/closing damper 140 and the second flow path opening/closing damper 150 may be located in different cold air flow path directions, instead of being located in the same cold air flow path directions.

The amount of cold air supplied to the first flow path opening/closing damper 140 and the amount of cold air supplied to the second flow path opening/closing damper 150 may be adjusted to be different from each other only by the arrangement relationship between the first flow path opening/closing damper 140 and the second flow path opening/closing damper 150.

One surface of the first damper case 141 may be disposed downward with respect to the grille fan assembly 100, and the first damper door 142 may be open and closed downward with respect to the grille fan assembly 100.

One surface of the second damper case 151 may be disposed downward with respect to the grille fan assembly 100, and the second damper door 152 may be open and closed downward with respect to the grille fan assembly 100.

As described above, since the first flow path opening/closing damper 140 and the second flow path opening/closing damper 150 according to the present disclosure are disposed in the grille fan assembly 100 close to the evaporator 101, freezing could occur by the evaporator 101.

In this instance, a defrost process of operating the first damper hot wire 146 of the first flow path opening/closing damper 140 and the second damper hot wire 156 of the second flow path opening/closing damper 150 may be performed.

When the defrost process is performed, defrosting water might be generated while the frozen area is melting.

In the present disclosure, the first damper door 142 of the first flow path opening/closing damper 140 may be opened to the lower area of the grille fan assembly 100, thereby reducing the defrosting water not properly discharged from the first flow path opening/closing damper 140 but collected in a specific area.

Most freezing may occur in an area where the first damper door contacts with one surface of the first damper case 141. Accordingly, when the first damper door 142 is open and closed downward, defrosting water at the frozen area may be smoothly discharged downward, without remaining in the first flow path opening/closing damper 140.

In the present disclosure, the second damper door 152 of the second flow path opening/closing damper 150 may be opened to the lower area of the grille fan assembly 100, thereby reducing the defrosting water not properly discharged from the second flow path opening/closing damper 150 but collected in a specific area.

Most freezing may occur in an area where the second damper door 152 contacts with one surface of the second damper case 151. Accordingly, when the second damper door 152 is open and closed downward, defrosting water at the frozen area may be smoothly discharged downward, without remaining in the second flow path opening/closing damper 150.

A water discharge hole 129 may be formed in a lower central region of the shroud 120 and the defrosting water may be discharged outside through the water discharge hole 129 of the shroud 120.

The first flow path opening/closing damper 140 may be inclined with respect to the left-right direction to dispose one surface of the first damper case 141 toward the direction in which the freezing fan module 160 is disposed.

In this instance, the first flow path opening/closing damper 140 may be inclined with respect to the left-right direction, in order to position the other surface of the first damper case 141 higher than one surface facing the other surface of the first damper case 141.

The grille fan assembly 100 according to the present disclosure may have a plurality of cold air flow guides 191, 192, 193 and 194 configured to guide the cold air flow path flowing therein.

The cold air flow path guide 191, 192, 193 and 194 may be formed in an island shape having a predetermined pattern to guide the cold air flow path.

For example, an ice-making chamber cold air flow guide 192 may be provided to mainly guide a flow path of cold air supplied to the ice-making chamber 22.

The ice-making chamber 192 may be disposed between the ice-making fan module 170 and the freezing fan module 160, to surround the ice-making fan module 170.

A freezer compartment cold air flow path guide 193 configured to mainly guide a flow path of cold air supplied to the freezer compartment 52 may be provided.

The freezer compartment cold air supply guide 193 may be disposed between the ice-making cold air flow guide 192 and the freezing fan module 160, and configured to form a cold air flow path in a space spaced apart from the ice-making chamber cold air flow path guide 192 and form a cold air flow path in a space spaced apart from the freezing fan module 160.

An auxiliary cold air flow path guide 194 may be formed below the freezer compartment cold air flow path guide 193.

Meanwhile, a refrigerator compartment cold air flow path guide 191 may be spaced a preset distance apart from the freezing fan module 160 and the first flow path opening/closing damper 140 in a downward direction.

The refrigerator compartment cold air flow path guide 191 may function to guide the cold air blown by the freezing fan module 160 toward the first flow path opening/closing damper 140.

Accordingly, an upper surface 191*a* of the refrigerator compartment cold air flow path guide 191 facing the freezing fan module 160 may have an upper end 191*b* disposed in a direction in which the first flow path opening/closing damper 140 is provided.

The lowermost point of the freezing fan module 160 may be lower than the lowermost point of the first flow path opening/closing module 130.

Accordingly, the other upper end 191*c* of the refrigerator compartment cold air flow path guide 191 close to the lowermost point of the freezing fan module 160 may be disposed lower than an upper side end 191*b* of the refrigerator compartment cold air flow path guide 191 close to the lowermost point of the first flow path opening/closing module 130.

Since the upper surface 191*a* of the refrigerator compartment cold air flow path guide 191 is formed to rise from the other upper end 191*c* toward the upper end 191*b*, the cold air blown by the freezing fan module 160 may be smoothly induced to the first flow path opening/closing module 130 along the upper surface 191*a* of the refrigerator compartment cold air flow path guide 191.

To induce more smooth flow of cold air, the direction of the upper end 191*b* of the upper surface 191*a* of the refrigerator compartment cold air flow path guide 191 may pass through the first damper through-hole 143 of the first flow path opening/closing damper 140.

Specifically, when a virtual line is drawn along the direction of the upper one end 191*b* of the upper surface 191*a* of the refrigerator compartment cold air flow path guide 191, the virtual line may pass through the inside of the first damper through-hole 143 of the first flow path opening/closing damper 140.

Accordingly, the cold air induced to the first flow path opening/closing damper 140 along the upper surface 191*a* of the refrigerator compartment cold air flow path guide 191 may pass through the first damper through-hole 143 without cold air loss as much as possible and without being obstructed by an area that is not the area through which the cold air passes (e.g., the area of the first damper operation motor).

When one side of the first damper case 141 in which the first damper operation motor 144 is provided may be disposed close to the freezing fan module 160, the cold air flowing into the first flow path opening/closing damper 140 may be obstructed by the first damper operation motor 144.

Accordingly, for the smooth flow of the cold air flowing into the first flow path opening/closing damper 140, one side of the first damper case 141 in which the first damper operation motor 144 is provided may be disposed in a direction that gets farther from the freezing fan module 160 than the other side of the first damper case 141.

Meanwhile, the second flow path opening/closing damper 150 may be horizontally disposed with respect to the left-right direction.

One side of the second damper case 151 in which the second damper operation motor 154 is provided may be disposed in a direction that gets closer to the freezing fan module 160 than the other side of the second damper case 151.

According to the present disclosure, the temperatures of the first storage chamber 51*a* and the second storage chamber 51*b* may be adjusted more efficiently and more effectively by adjusting the amount of the cold air passing through the second flow path opening/closing damper 150 to be smaller than the amount of the cold air passing through the first flow path opening/closing damper 140.

Accordingly, the second flow path opening/closing damper 150 may have one surface that is horizontally disposed with respect to the left-right direction, not inclined toward the freezing fan module 160, in order to adjust the amount of the cold air induced into the second flow path opening/closing module 130 to be smaller.

In addition, since one side of the second damper case in which the second damper operation motor 154 is disposed close to the freezing fan module 160 than the other side, the second damper operation motor 154 could be positioned to intentionally interfere with the cold air induced to the second flow path opening/closing damper 150.

Accordingly, the amount of the cold air flow induced to the second flow path opening/closing module 130 may be adjusted to be smaller than that of the cold air flow induced to the first flow path opening/closing module 130 by the arrangement of the second damper operation motor 154.

The grille fan assembly 100 according to the present disclosure may efficiently and smoothly adjust the amounts of the cold air supplied to the dampers to be different by the arrangement structure of the first and second flow path opening/closing dampers 140 and 150.

To this regard, the freezing fan module 160 may be disposed to have the larger overlapping area with the first flow path opening/closing damper 140 than the overlapping area with the second flow path opening/closing damper 150 with respect to the left-right direction of the grille fan assembly 100.

For example, the freezing fan module 160 may overlap with the first flow path opening/closing damper 140 with respect to the left-right direction, but not overlap with the second flow path opening/closing damper 150.

As described above, it is necessary to adjust the amount of the cold air supplied to the first storage chamber 51*a* to be different from that of the cold air supplied to the second storage chamber 51*b* in order to adjust the first and second storage chambers at different temperatures.

The cold air guided to the flow path opening/closing module 130 may be branched at the first flow path opening/closing damper 140 and the second flow path opening/closing damper 150 and then supplied to the first storage chamber 51*a* and the second storage chamber 51*b*.

In this instance, since the first flow path opening/closing damper 140 is disposed to overlap more with the freezing fan module 160 in the left-right direction, the cold air blown by the freezing fan module 160 may be directly guided more to the first flow path opening/closing damper 140.

Figure 6A:
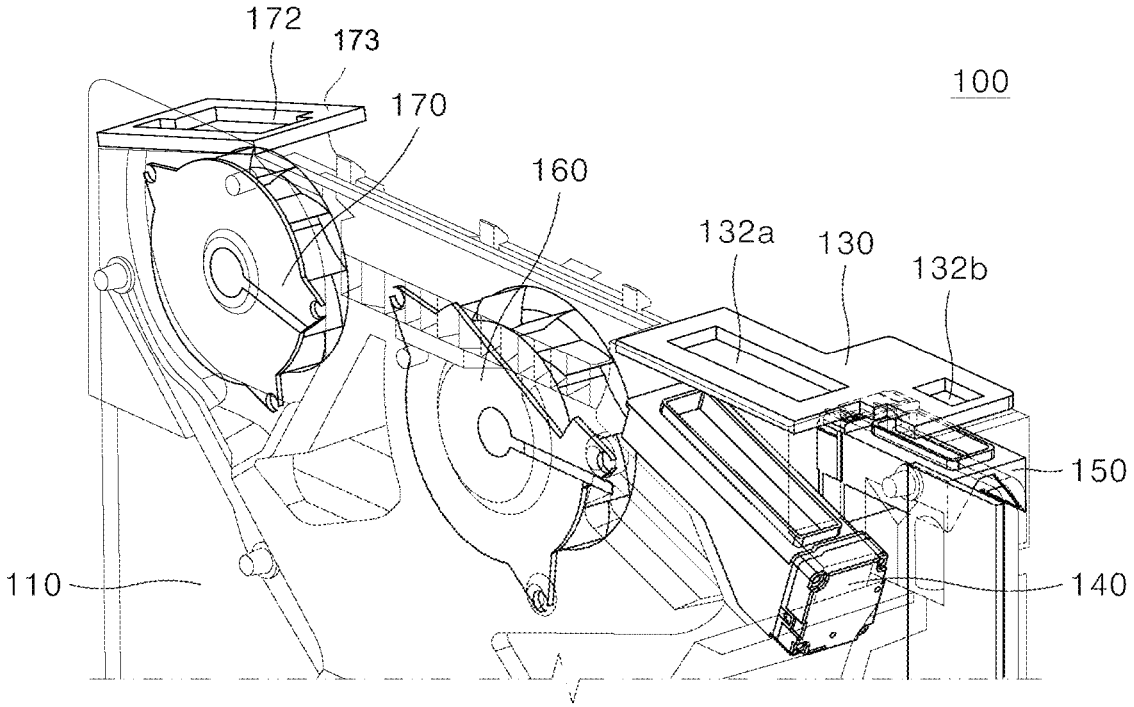
FIGS. 6A-6C are front views of a refrigerator including a grille fan assembly and a refrigerator compartment cold air supply duct, which shows a perspective-viewed inside.
Figure 6B:
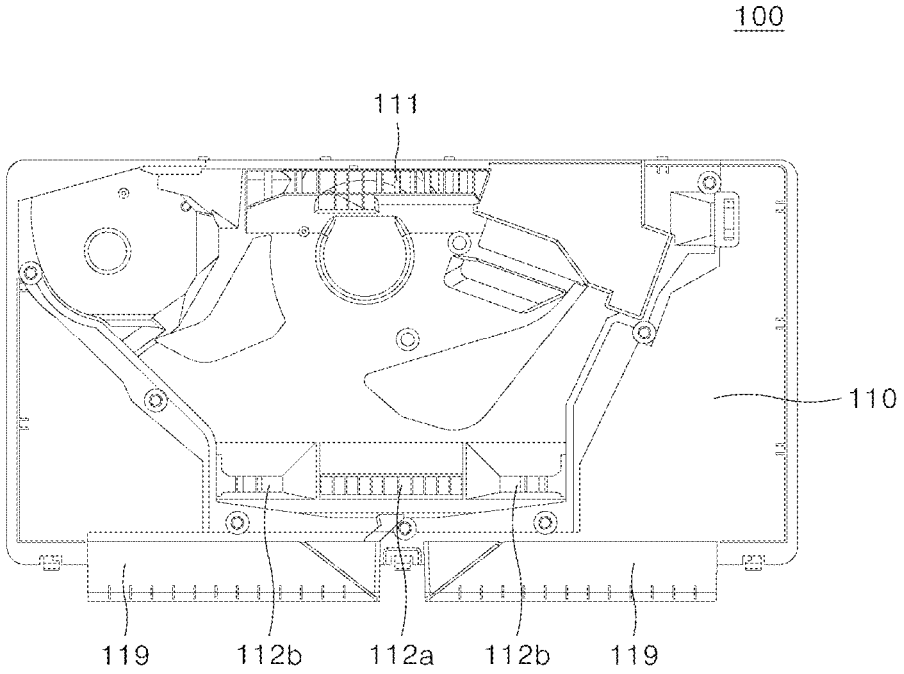
Figure 6C:
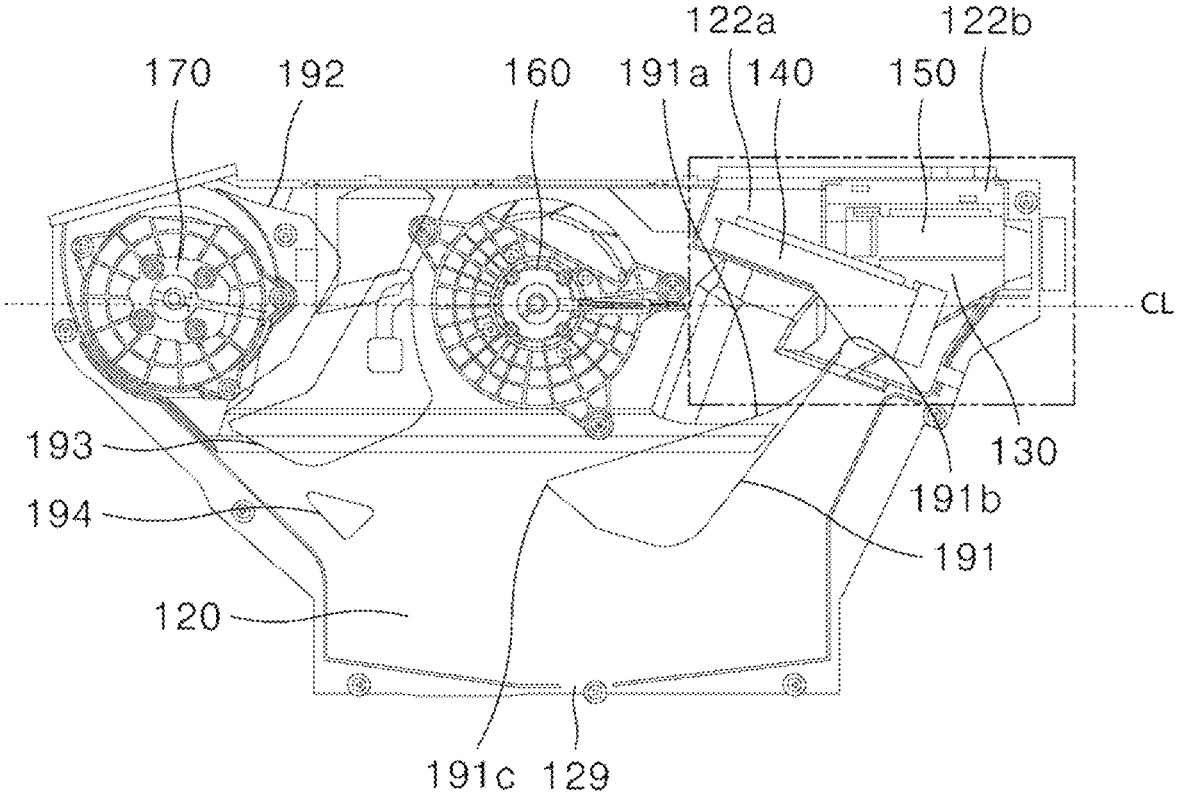
Figure 7:
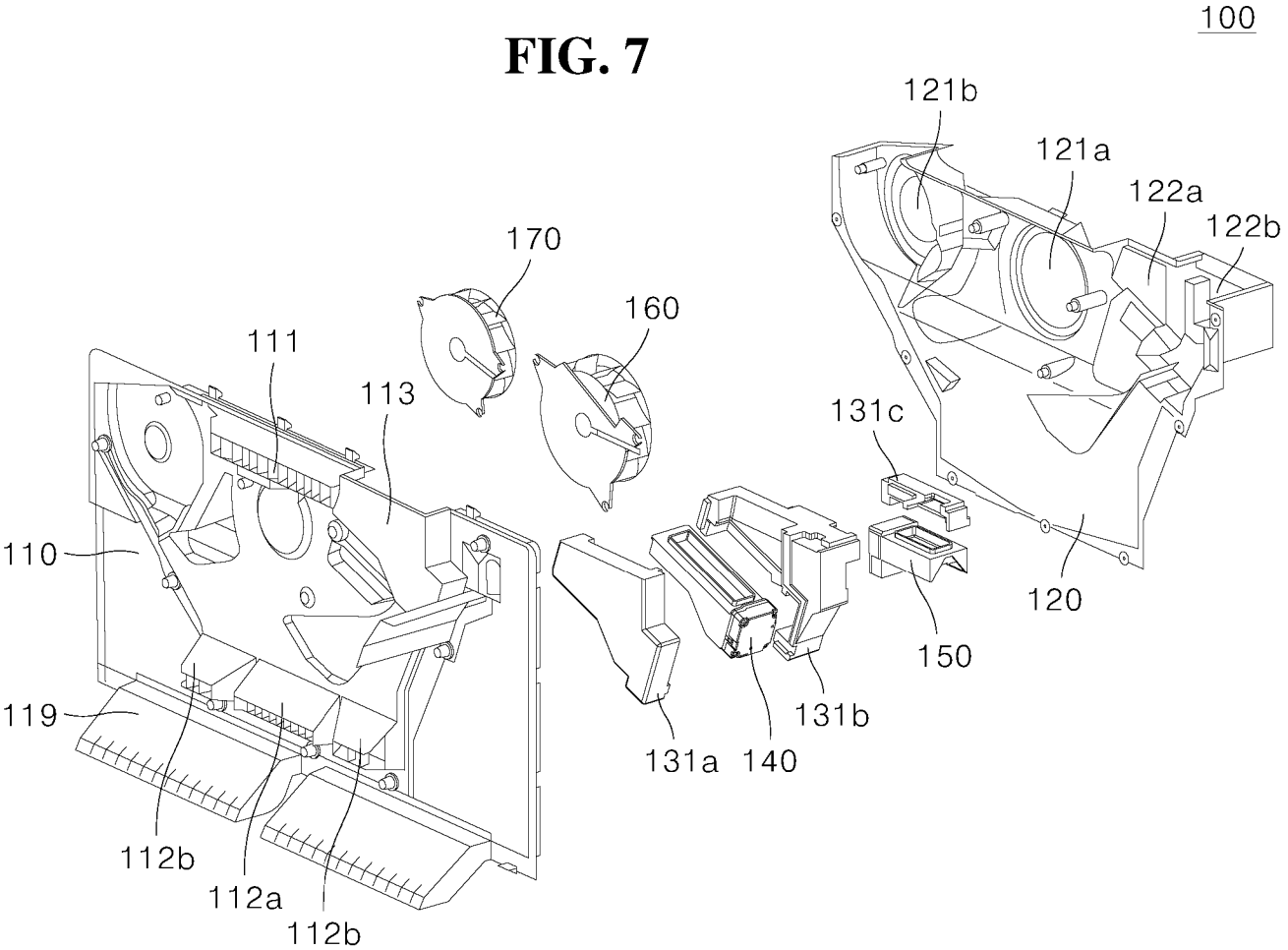
FIG. 7 is an exploded perspective view of a grille fan assembly.

Meanwhile, referring to FIG. 6C, the first flow path opening/closing damper 140 may overlap with a horizontal center line of the freezing fan module 160 in at least predetermined area.

It is preferred that the first damper operation motor 144 of the first flow path opening/closing damper 140 may overlap with the horizontal center line of the freezing fan module 160.

As described above, at least predetermined area of the first flow path opening/closing damper 140 overlap with the horizontal center line of the freezing fan module 160, and the first damper operation motor 144 of the first flow path opening/closing damper 140 may overlap with the horizontal center line, so that the freezing of the first damper operation motor 144 may be reduced while the cold air blown by the freezing fan module 160 smoothly flows as much as possible.

While the second flow path opening/closing damper 150 may be disposed in an upper area with respect to the horizontal center line of the freezing fan module 160, the first damper operation motor 144 may overlap with the horizontal center line. Due to this structure, the cold air blown by the freezing fan module 160 may flow smoothly and the freezing of the first damper operation motor 144 may be also reduced as much as possible.

The second flow path opening/closing damper 150 may be disposed not to overlap with the horizontal center line of the freezing fan module 160.

It is preferred that the second flow path opening/closing damper 150 may be disposed higher than the horizontal center line.

As described above, the second flow path opening/closing damper 150 may be disposed not to overlap with the horizontal center line of the freezing fan module 160, and the second damper operation motor 154 of the second flow path opening/closing damper 150 may be disposed higher than the horizontal center line. Accordingly, the freezing of the second damper operation motor 154 caused by the evaporator 101 may be reduced.

Meanwhile, the flow path opening/closing module 130 configured to selectively block the cold air generated by the evaporator 101 from being supplied to the refrigerator compartment 51 may be disposed in the freezer compartment 52.

The flow path opening/closing module 130 may include the first flow path opening/closing damper 140, and the first flow path opening/closing damper 140 may be configured to selectively cut off the cold air supplied to the first storage chamber 51*a* through the refrigerator compartment cold air supply duct 300.

The first flow path opening/closing damper 140 may selectively cut off the cold air supplied to the first storage chamber 51*a* through the connection duct 200 and the refrigerator compartment cold air supply duct 300.

The second flow path opening/closing damper 150 may selectively cut off the cold air supplied to the second storage chamber 51*b* through the second storage chamber cold air supply duct 400.

As described above, the first flow path opening/closing damper 140 for selectively blocking the cold air supply to the first storage chamber 51*a* and the second flow path opening/closing damper 150 for selectively blocking the cold air supply to the second storage chamber 51*b* may be provided in the freezer compartment 52, not the refrigerator compartment 51.

If the flow path opening/closing dampers 140 and 150 are provided in the refrigerator compartment 51, the refrigerator compartment 51 may be projected further inward as much as the area occupied by the first and the second flow path opening/closing dampers 140 and 150, thereby reducing the inner volume of the refrigerator compartment 51.

However, since the flow path opening/closing module 130 including the flow path opening/closing dampers 140 and 150 is provided in the freezer compartment 52, not the refrigerator compartment 51, the area projected to the inside of the refrigerator compartment 51 may be reduced and then the inner volume of the refrigerator compartment 51 may be increased.

In addition, in the refrigerator 1 according to the present disclosure, the flow path opening/closing module 130 including the flow path opening/closing dampers 140 and 150 is disposed in the freezer compartment 52 not the freezer compartment 52. Accordingly, even when the flow path opening/closing dampers 140 and 150 are closed, the cold air inside the freezer compartment 52 will not rise to the refrigerator compartment 51 but stay inside the freezer compartment 52.

Accordingly, the refrigerator 1 of the present disclosure may greatly reduce dew condensation near the flow path opening/closing dampers 140 and 150.

Since the flow path opening/closing module 130 provided in the grille fan assembly 100 adjusts the cold air supplied to the refrigerator compartment 51, the refrigerator 1 according to the present disclosure may provide a new cold air supply system.

If the flow path opening/closing module 130 is disposed in the refrigerator compartment 51 not the freezer compartment 52, the inner volume of the refrigerator compartment 1 may be reduced as much as the space occupied by the flow path opening/closing module 130.

Accordingly, since the flow path opening/closing module 130 for selectively blocking the cold air supplied to the refrigerator compartment 51 is provided in the grille fan assembly 100 for blowing the cold air generated by one evaporator 101 to the freezer compartment 52, it may not be necessary to secure a separate additional space for disposing the flow path opening/closing module 300 in the refrigerator compartment 51.

Due to this structure, the refrigerator 1 may have a new cold air supply system capable of enhancing capacity competitiveness of the refrigerator 1.

In the embodiment, the refrigerator 1 having the new cold air supply system capable of enhancing the capacity competitiveness is characterized in that one grille fan assembly 100 disposed in the refrigerator compartment 52 and configured to supply cold air to the ice-making chamber 22, the refrigerator compartment 51 and the freezer compartment 52 may include two flow path opening/closing dampers 140 and 150 configured to selectively cut off the cold air supplied to the refrigerator compartment 51. However, the present disclosure is not limited the above-noted embodiment.

Figure 16:
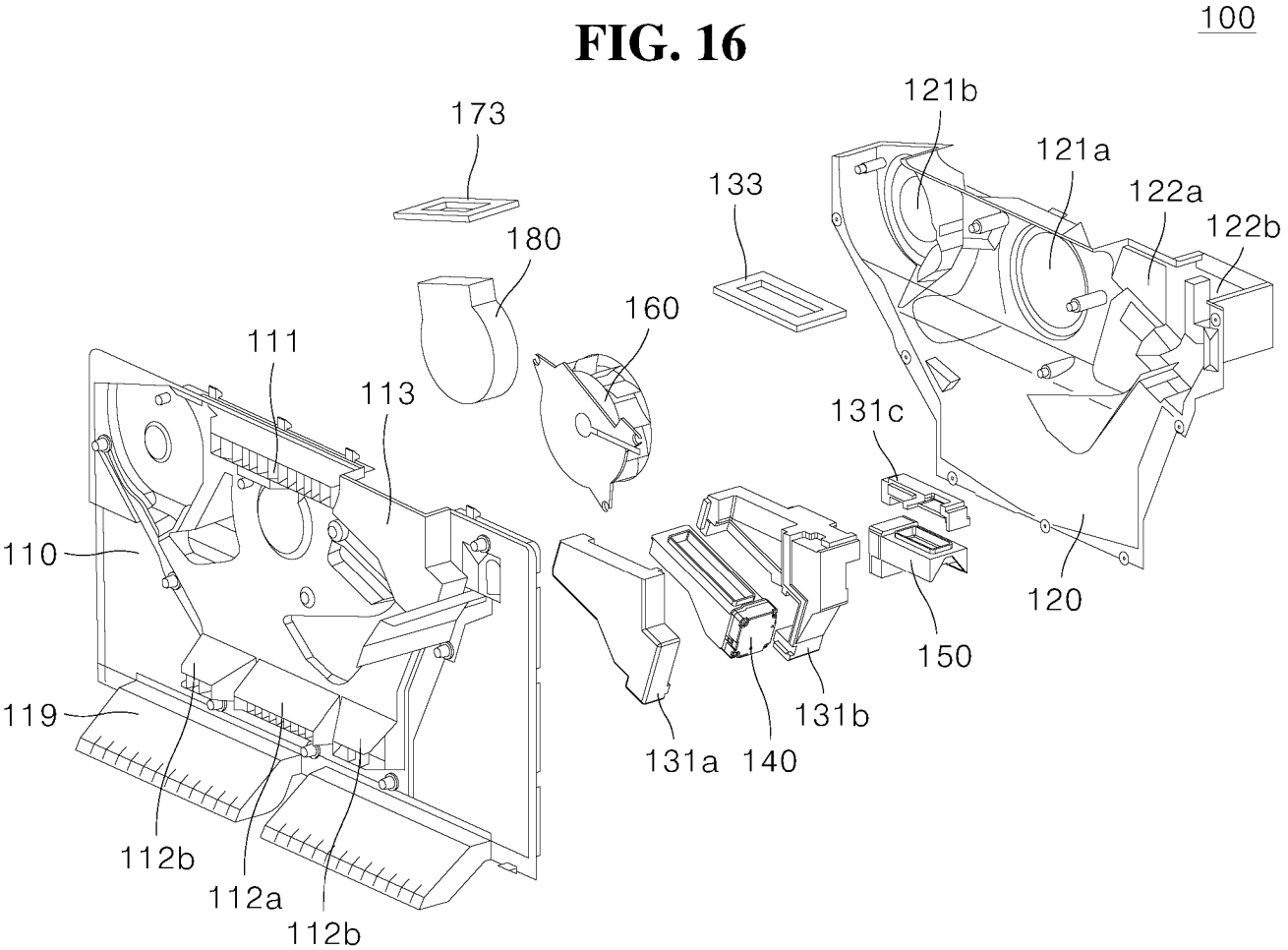
FIG. 16 is an exploded perspective view of a grille fan assembly having no ice-making chamber.

As another example, referring to FIG. 16, one grille fan assembly 100 may be applied to the refrigerator having no ice-making chamber and no ice-making chamber module fan.

Specifically, the grille fan assembly 100 according to another embodiment may include a flow path blocking member 180, a freezing fan module 160 and flow path opening/closing dampers 140 and 150, which are disposed between the shroud 120 and the grille fan assembly wall 110.

The freezing fan module 160 may be disposed in the first inlet hole 121*a* of the shroud 120, and the flow path blocking member 180 may be disposed in the second inlet hole 121*b* of the shroud 120.

The flow path blocking member 180 may have a shape capable of blocking the cold air flowing into the second inlet hole 121*b*.

That is, the cold air may be prevented from leaking through the ice-making chamber cold air outlet guide 173 by arranging the flow path blocking member 180 at the position where the ice-making fan module 170 is provided.

Accordingly, in case of the refrigerator without the ice-making chamber 22, the grille fan assembly 100 without a separate change of a shape may be used only by providing the flow path blocking member 180, thereby enhancing assembly process assembly.

One objective of the present disclosure is to provide a new refrigerator having a structure of arranging flow path opening/closing dampers configured to supply the desired amount to a refrigerator compartment including first and second storage chambers as well as a freezer compartment by efficiently and smoothly adjusting the amount of the cold air blown by one grille fan assembly.

A further objective of the present disclosure is to provide a refrigerator that may increase an inner volume of a refrigerator compartment by reducing an area occupied by a projected portion projected to the inside of the refrigerator compartment by reducing components related to a cold air supply system disposed on a rear outer surface of the refrigerator compartment.

Aspects according to the present disclosure are not limited to the above ones, and other aspects and advantages that are not mentioned above can be clearly understood from the following description and can be more clearly understood from the embodiments set forth herein.

A refrigerator according to an embodiment of the present disclosure is characterized in that a first flow path opening/closing damper and a second flow path opening/closing damper overlap with each other in at least predetermined area in a front-rear direction.

Specifically, the refrigerator may arrange the first flow path opening/closing damper for selectively blocking the cold air blown to a first storage chamber and the second flow path opening/closing damper for selectively blocking the cold air blown to a second storage chamber to overlap with each other in at least predetermined area in a front-rear direction. accordingly, the amounts of the cold air supplied to the first storage chamber and the second storage chamber may be efficiently and smoothly adjusted by the arrangement structure of the flow path opening/closing dampers.

The refrigerator may include an evaporator configured to generate cold air; and a grille fan assembly configured to blow the cold air generated by the evaporator to a refrigerator compartment and a freezer compartment. The grille fan assembly may include a freezing fan module configured to blow cold air to the refrigerator compartment comprising a first storage chamber and a second storage chamber and the freezer compartment; a first flow path opening/closing damper configured to selectively block the cold air blown to the first storage chamber; and a second flow path opening/closing damper configured to selectively block the cold air blown to the second storage chamber, and the first flow path opening/closing damper and the second flow path opening/closing damper may overlap in at least predetermined area in a front-rear direction.

In an embodiment, the first flow path opening/closing damper may include a first damper case comprising a first damper through-hole through which cold air passes; a first damper door disposed on one surface of the first damper case and configured to open and close the first damper through-hole; and a first damper operation motor disposed in one side of the first damper case and configured to open and close the first damper door. One surface of the first damper case may be disposed toward a lower area of the grille fan assembly, and the first damper door may be open and closed toward the lower area of the grille fan assembly.

The first flow path opening/closing damper may be inclined with respect to a left-right direction to direct one surface of the first damper case toward the freezing fan module.

The first flow path opening/closing damper may be inclined with respect to the left-right direction to locate the other surface facing one surface of the first damper case at a position higher than one surface of the first damper case.

One surface of the first damper case on which the first damper operation motor is disposed may be disposed farther from the freezing fan module than the other surface of the first damper case.

A first damper hot wire may be disposed on one surface of the first damper case, and the first damper hot wire may be disposed at a position corresponding to a periphery of the first damper door.

The second flow path opening/closing damper may include a second damper case comprising a second damper through-hole through which cold air passes; a second damper door disposed on one surface of the second damper case and configured to open and close the second damper through-hole; and a second damper operation motor disposed in one side of the second damper case and configured to open and close the second damper door. One surface of the second damper case may be disposed toward a lower area of the grille fan assembly, and the second damper door may be open and closed toward the lower area of the grille fan assembly.

The second flow path opening/closing damper may be horizontally disposed with respect to a left-right direction.

One surface of the second damper case on which the second damper operation motor is disposed may be disposed close to the freezing fan module than the other surface of the second damper case.

A second damper hot wire may be disposed on one surface of the second damper case, and the second damper hot wire may be disposed at a position corresponding to a periphery of the second damper door.

The cold air blown by the freezing fan module may be guided more to the first flow path opening/closing damper than the second flow path opening/closing damper.

In the refrigerator, the freezing fan module may have a larger overlapping area with the first flow path opening/closing damper than an overlapping area with the second flow path opening/closing damper with respect to left-right direction.

Since the freezing fan module may have a larger overlapping area with the first flow path opening/closing damper than an overlapping area with the second flow path opening/closing damper with respect to left-right direction, the amounts of cold air supplied to the first storage chamber and the second storage chamber may be efficiently and smoothly adjusted by the arrangement structure of the flow path opening/closing dampers.

In another aspect of the present disclosure, a refrigerator may include an evaporator configured to generate cold air; and a grille fan assembly configured to blow the cold air generated by the evaporator to a refrigerator compartment and a freezer compartment, wherein the grille fan assembly may include a freezing fan module configured to blow cold air to the refrigerator compartment comprising a first storage chamber and a second storage chamber and the freezer compartment; and a flow path opening/closing module comprising a first flow path opening/closing damper configured to selectively block the cold air blown to the first storage chamber, and a second flow path opening/closing damper configured to selectively block the cold air blown to the second storage chamber. The freezing fan module may have a larger area overlapping with the first flow path opening/closing damper than an overlapping area with the second flow path opening/closing damper with respect to a left-right direction.

The freezing fan module may be disposed to overlap with the first flow path opening/closing damper with respect to a left-right direction and not to overlap with second flow path opening/closing damper.

The flow path opening/closing module may further include a damper cover configured to cover the first flow path opening/closing damper and the second flow path opening/closing damper. The damper cover may include a first damper cover, a second damper cover and a third damper cover. The first damper cover and the second damper cover may be configured to cover the first flow path opening/closing damper. The second damper cover and the third damper cover may be configured to cover the second flow path opening/closing damper.

The refrigerator may further include a grille fan assembly wall comprising a first flow path opening/closing module opposite side seating portion on which the first damper cover is seated; and a shroud disposed to face the grille fan assembly wall, the shroud comprising a first flow path opening/closing module one surface seating portion on which the second damper cover is seated, and a second flow path opening/closing module seating portion on which the third damper cover is seated.

A step may be formed from the first flow path opening/closing module one side seating portion to the second flow path opening/closing module seating portion.

The second flow path opening/closing module seating portion may be projected more toward a rear surface of the shroud than the first flow path opening/closing module one surface seating portion.

The first flow path opening/closing damper may have at least predetermined area overlapping with a horizontal center line of the freezing fan module.

A first damper operation motor of the first flow path opening/closing damper may be disposed to overlap with the horizontal center line of the freezing fan module.

The second flow path opening/closing damper may be disposed not to overlap with the horizontal center line of the freezing fan module.

The second flow path opening/closing damper may be disposed higher than the horizontal center line of the freezing fan module.

The cold air blown by the freezing fan module may be guided more to the first flow path opening/closing damper than the second flow path opening/closing damper.

The refrigerator may arrange the first flow path opening/closing damper for selectively blocking the cold air blown to a first storage chamber and the second flow path opening/closing damper for selectively blocking the cold air blown to a second storage chamber to overlap with each other in at least predetermined area in a front-rear direction. accordingly, the amounts of the cold air supplied to the first storage chamber and the second storage chamber may be efficiently and smoothly adjusted by the arrangement structure of the flow path opening/closing dampers.

Since the freezing fan module may have a larger overlapping area with the first flow path opening/closing damper than an overlapping area with the second flow path opening/closing damper with respect to left-right direction, the amounts of cold air supplied to the first storage chamber and the second storage chamber may be efficiently and smoothly adjusted by the arrangement structure of the flow path opening/closing dampers.

In addition, the refrigerator may reduce components related to the cold air supply system disposed on the outer rear surface of the refrigerator compartment by arranging the flow path opening/closing damper for selectively blocking cold air supply to the refrigerator compartment in the freezer compartment, not the refrigerator compartment.

Accordingly, the refrigerator may reduce the area projected to the inside of the refrigerator compartment and increase the inner volume of the refrigerator compartment, thereby enhancing the capacity competitiveness of the refrigerator.

Specific effects are described along with the above-described effects in the section of Detailed Description.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

an evaporator configured to provide cold air; and a grille fan assembly configured to blow the cold air provided by the evaporator to a refrigerator compartment and a freezer compartment, the refrigerator compartment including a first storage chamber and a second storage chamber, wherein the grille fan assembly includes:

a grille fan assembly wall;

a shroud disposed to face the grille fan assembly wall;

a fan module configured to blow the cold air to the first storage chamber, the second storage chamber, and the freezer compartment;

a first damper configured to selectively block the cold air to be provided to the first storage chamber; and a second damper configured to selectively block the cold air to be provided to the second storage chamber, wherein the first damper and the second damper at least partially overlap in a frontward-rearward direction, wherein the first damper, the second damper, and the fan module are positioned between the grille fan assembly wall and the shroud, and wherein a single cold air path through which the cold air blown from the fan module flows is configured to be branched and controlled by the first damper and the second damper.

2. The refrigerator of claim 1, wherein the first damper includes:

a first damper case having a first damper through-hole through which the cold air passes;

a first damper door disposed on a first surface of the first damper case, and configured to open and close the first damper through-hole; and a first damper motor disposed at the first side of the first damper case, and configured to open and close the first damper door, wherein the first surface of the first damper case is disposed downward toward a lower area of the grille fan assembly, and wherein the first damper door is to open toward the lower area of the grille fan assembly.

3. The refrigerator of claim 2, wherein the first damper is inclined with respect to a lateral direction to direct the first surface of the first damper case toward the fan module.

4. The refrigerator of claim 2, wherein the first damper is inclined with respect to a lateral direction such that a second side of the first damper case is disposed at a position higher than the first side of the first damper case.

5. The refrigerator of claim 4, wherein the second side of the first damper case is closer to the fan module than the first side of the first damper case.

6. The refrigerator of claim 2, wherein a hot wire is disposed on the first surface of the first damper case, and wherein the hot wire is disposed at a periphery of the first damper door.

7. The refrigerator of claim 2, wherein the second damper includes:

a second damper case having a second damper through-hole through which the cold passes;

a second damper door disposed on a first surface of the second damper case, and configured to open and close the second damper through-hole; and a second damper motor disposed at a first side of the second damper case, and configured to open and close the second damper door, wherein the first surface of the second damper case is disposed downward toward a lower area of the grille fan assembly, and wherein the second damper door is to open toward the lower area of the grille fan assembly.

8. The refrigerator of claim 7, wherein the second damper is horizontally disposed with respect to a lateral direction.

9. The refrigerator of claim 7, wherein the first side of the second damper case is disposed closer to the fan module than a second side of the second damper case.

10. The refrigerator of claim 7, wherein a hot wire is disposed on the first surface of the second damper case, and wherein the hot wire is disposed at a periphery of the second damper door.

11. The refrigerator of claim 1, wherein more of the cold air blown by the fan module is guided to the first damper than to the second damper.

12. A refrigerator, comprising:

an evaporator configured to provide cold air; and a grille fan assembly configured to blow the cold air to a refrigerator compartment and a freezer compartment, the refrigerator compartment including a first storage chamber and a second storage chamber, wherein the grille fan assembly includes:

a grille fan assembly wall;

a shroud disposed to face the grille fan assembly wall;

a fan module configured to blow the cold air to the first storage chamber, the second storage chamber, and the freezer compartment; and a first damper configured to selectively block the cold air being blown to the first storage chamber, and a second damper configured to selectively block the cold air being blown to the second storage chamber, wherein a first area of the fan module overlaps in a lateral direction with the first damper and a second area of the fan module overlaps with the second damper, and the first area of the fan module is larger than the second area of the fan module, or wherein the fan module overlaps in the lateral direction with the first damper and the fan module does not overlap with second damper in the lateral direction, wherein the first damper, the second damper, and the fan module are positioned between the grille fan assembly wall and the shroud, and wherein a single cold air path through which the cold air blown from the fan module flows is configured to be branched and controlled by the first damper and the second damper.

13. The refrigerator of claim 12, wherein the grille fan assembly further includes a first damper cover, a second damper cover and a third damper cover, wherein the first damper cover and the second damper cover are configured to cover the first damper, and wherein the second damper cover and the third damper cover are configured to cover the second damper.

14. The refrigerator of claim 13, wherein the shroud includes a first seating portion on which the second damper cover is provided, and a second seating portion on which the third damper cover is provided, and wherein the grille fan assembly wall includes a third seating portion on which the first damper cover is provided.

15. The refrigerator of claim 14, wherein a step is provided in a connecting area from the first seating portion to the second seating portion.

16. The refrigerator of claim 14, wherein the second seating portion protrudes more toward a rear surface of the shroud than the first seating portion.

17. The refrigerator of claim 12, wherein at least a partial area of the first damper overlaps with a horizontal center line of the fan module.

18. The refrigerator of claim 17, wherein a first damper motor of the first damper overlaps with the horizontal center line of the fan module.

19. The refrigerator of claim 17, wherein the second damper does not overlap with the horizontal center line of the fan module.

20. The refrigerator of claim 19, wherein the second damper is disposed higher than the horizontal center line of the fan module.

21. The refrigerator of claim 12, wherein more of the cold air blown by the fan module is guided to the first damper than the second damper.

* * * * *